US006443551B1

(12) United States Patent
Matsumoto

(10) Patent No.: US 6,443,551 B1
(45) Date of Patent: Sep. 3, 2002

(54) METHOD AND APPARATUS FOR FORMING IMAGE USING IMAGE FORMING LIQUID ENVELOPED IN IMAGE NON-FORMING LIQUID

(75) Inventor: Nobuo Matsumoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 7 days.

(21) Appl. No.: 09/648,536

(22) Filed: Aug. 28, 2000

(30) Foreign Application Priority Data

Aug. 27, 1999 (JP) ..... 11-240843
Mar. 17, 2000 (JP) ..... 2000-076496

(51) Int. Cl.[7] ..... B41J 2/015

(52) U.S. Cl. ..... 347/21; 347/101; 347/100; 347/98

(58) Field of Search ..... 347/100, 98, 95, 347/101, 43, 20, 21

(56) References Cited

U.S. PATENT DOCUMENTS 4,109,282 A * 8/1978 Robertson et al. ..... 347/98
4,196,437 A * 4/1980 Hertz ..... 347/98
4,614,953 A 9/1986 Lapeyre ..... 346/140 R
5,371,529 A 12/1994 Eguchi et al. ..... 347/7

FOREIGN PATENT DOCUMENTS

JP 3-207664 9/1991 ..... B41J/2/21
JP 5-201024 8/1993 ..... B41J/2/175
JP 7-125259 5/1995 ..... B41J/2/205
JP 9-156131 6/1997 ..... B41J/2/21

OTHER PUBLICATIONS

Patent Abstracts of Japan 05201024 Aug. 10, 1993.
English language abstract JP7125259 May 16, 1995.
English language abstract JP3207664 Sep. 10, 1991.
English language abstract JP9156131 Jun. 17, 1997.

* cited by examiner

*Primary Examiner*—David F. Yockey
*Assistant Examiner*—Manish Shah
(74) *Attorney, Agent, or Firm*—Sughrue Mion, PLLC

(57) ABSTRACT

There is disclosed an image forming method and apparatus for ejecting a recording liquid including an image forming and non-forming liquids from a recording liquid ejection port while changing a mixture proportion based on an image signal. The ejected recording liquid is transferred to an image receiving medium to form an image thereon. The image forming liquid is extruded into a flow of the image non-forming liquid in a recording liquid channel, and led to the ejection port so that the image-forming liquid fails to contact an inner wall surface of the recording liquid channel. The image non-forming liquid flows as a laminar flow in the recording liquid channel, and the image forming liquid is extruded into the laminar flow, surrounded and enveloped by the image non-forming liquid and led to the ejection port. The recording liquid fails to be disordered before reaching the image receiving medium, and image quality can be prevented from being deteriorated. This prevents blur of pixel density (color) from being generated and enhances an image quality. A viscosity of an image non-forming liquid is preferably set to be smaller than the viscosity of an image forming liquid.

34 Claims, 14 Drawing Sheets

IMAGE BY HEAD
WITH NO INFLUENCE
OF VISCOSITY

IMAGE BY HEAD WITH
LARGE INFLUENCE OF
VISCOSITY

METHOD AND APPARATUS FOR FORMING IMAGE USING IMAGE FORMING LIQUID ENVELOPED IN IMAGE NON-FORMING LIQUID

BACKGROUND OF THE INVENTION

1. Field of the Invention

The present invention relates-to an image forming method for producing a recording liquid having a predetermined density and/or a predetermined color by changing a mixture proportion of an image non-forming liquid with one type or a plurality of types of image forming liquid based on an image signal and leading this recording liquid to an image receiving medium to form an image. The present invention further relates to an image forming apparatus by this method.

2. Description of the Prior Art

There has been proposed an image forming method, in which different colors of ink are mixed based on an image signal in advance and transferred to an image receiving medium such as a print paper (for example, U.S. Pat. Nos. 4,109,282 and 4,614,953, Unexamined Japanese Patent Publication (KOKAI) Nos. 201024/1993, 125259/1995, 207664/1991 and 156131/1997). Such method of using a fluid whose density/color is preset in response to the image signal to form an image is called a pre-mix mode. According to the mode, the density or the color can be adjusted for each pixel based on the image signal, an image quality can be enhanced.

U.S. Pat. No. 4,109,282 discloses a printer having a structure such that a valve called a flap valve is provided in a flow channel for leading two types of liquid, i.e., clear ink and black ink onto a substrate for forming an image. The flow channel for each ink is opened/closed by displacing this valve so that the two types of liquid are mixed in a desired density to be transferred onto the substrate. This enables printout of an image having the same gray scale information as that of image information displayed on a TV screen.

In this reference it is disclosed that a voltage is applied between the flap valve and an electrode provided on a surface opposite to the flap valve and the valve itself is mechanically deformed by an electrostatic attracting force to cause displacement of the valve. The ink is absorbed by a capillary phenomenon between fibers of the print paper. However, since this apparatus joins and mixes the two types of liquid on the substrate immediately after ejection, the system is exactly different from the aforementioned pre-mix mode.

U.S. Pat. No. 4,614,953 discloses an ink jet printer head apparatus in which only desired amounts of a plurality of types of ink having different colors and solvent are led to a third chamber to be mixed therein and flied as an ink droplet. In this reference, a chamber and a diaphragm-type piezoelectric effect device attached to this chamber are used as means for check-weighing a desired amount of ink and a pressure pulse obtained by driving this piezoelectric device is used.

Unexamined Japanese Patent Publication (KOKAI) No. 201024/1993 discloses an ink jet print head including: a liquid chamber filled with a carrier liquid; ink jet driving means disposed in the liquid chamber; a nozzle communicating with the liquid chamber; and a mixing portion for mixing ink to the carrier liquid in this nozzle. Here it is also disclosed that adjusting means for adjusting a mixture amount of ink to obtain a desired value is provided.

Similarly, Unexamined-Japanese Patent Publication (KOKAI) No. 125259/1995 discloses an ink jet recording head including: first and second supplying means for supplying ink having first and second densities, respectively; and controlling means which controls a supply amount of the second ink by the second supplying means so that a desired ink density can be obtained.

In this reference, employment of a micro-pump which has an exclusive heating device and is driven by its heat energy is disclosed as the controlling means. As this micro-pump, an example is disclosed in which the heat energy is generated by the heating-device and a pressure obtained by nucleate boiling caused due to the heat energy is used to drive, for example, a piston-type valve or a cantilever-like valve. Further, this reference describes that an inflow of ink can effectively be controlled in an area where the inflow is particularly small by adopting an actuator consisting of shape memory alloy with this valve.

Unexamined Japanese Patent Publication (KOKAI) No. 207664/1991 discloses an ink jet printer having a structure similar to that disclosed in the above mentioned U.S. Pat. No. 4,614,953, but a third chamber for mixing a plurality of types of ink is not used.

Unexamined Japanese Patent Publication (KOKAI) No. 156131/1997 discloses an ink jet printer comprising a plurality of printer heads for forming an image having multiple colors based on image data. Ink and diluent are mixed at a predetermined mixing ratio to obtain a diluted ink which is jetted from a nozzle so that a recording image is formed on a recording medium. The ink jet printer ejects the diluent from at least one printer head out of a plurality of printer heads when all-white image data, that is, data representing that the mixture amount of ink is too small to realize a clear printing density, is inputted to the plurality of printer heads. As a result, a rapid change in tone (a tone jump) is prevented and the additional consumption of the diluent is suppressed to improve drying characteristics.

The U.S. Pat. No. 4,109,282 discloses a technique of controlling the supply amount of one type of ink to be mixed, that is, black ink. Therefore, a liquid flow rate of the mixed ink having the desired density, that is, a volumetric flow rate per unit time varies in accordance with a change in density.

As a mode in place of an ink jet mode, the applicant and his collaborators have been examining a mode for continuously transferring the ink liquid to an image receiving medium as a continuous flow without making a liquid droplet (hereinafter referred to as a continuous coating mode). Even in this mode, the aforementioned change of the supply amount of the mixed ink results in a disordered and unstable liquid flow. It has been revealed that a fluctuation of a volumetric flow rate (also referred to simply as the flow rate, hereinafter) per unit time of the mixed ink liquid due to the change of the mixing ratio of the inks results in various problems such as remarkable deterioration of quality of a finally formed image. Also when the color is changed by mixing a plurality of types of ink, similar problems occur.

Specifically, it is desirable that the ink liquid is transferred to the image receiving medium as a steady laminar flow. If a disorder or a whirlpool occurs in this flow, the image quality is deteriorated. Moreover, a fluctuation of the supply amount of the liquid leads to formation of coating film having various thickness on the image receiving medium, but it is very difficult to steadily form the coating film having varied or fluctuated thickness depending on a structure of a liquid ejection port. Even if the formation of such coating film is possible, irregularity is generated on the surface of the image, and the transferred liquid having the irregular surface in a liquid state tends to spread and smoothen the irregular surface, which deteriorates the image quality.

Moreover, in the continuous coating mode an image recording liquid needs to be continuously supplied between the recording head and the image receiving medium. However, the recording liquid flows slow on a portion in contact with a surface of the recording head, due to viscosity of the recording liquid. This causes a problem that delay is generated in a recording liquid coating position and the image quality is deteriorated.

In order to avoid the disadvantage, it is proposed to interpose liquids which form substantially no image after image formation, such as a clear liquid (hereinafter referred to as an image non-forming liquid, or simply a clear ink) so that the recording liquid fails to directly contact the surface of the recording head. For this purpose, it is proposed that the recording head is provided with a clear liquid ejection port separately from a recording liquid ejection port, and that the clear liquid is supplied to the portion between the recording head surface and the recording liquid. However, when the ejection portion for the clear liquid is disposed, a recording head structure is complicated and enlarged, and reliability is disadvantageously deteriorated.

Moreover, in the conventional pre-mix mode, even when a plurality of types of ink are mixed in advance at a mixture proportion based on the image signal, an ink velocity distribution in an ink flow path or channel inevitably changes in a position close to an inner wall of the ink channel and a far position until the ink reaches the ink ejection port. Specifically, an ink phase is advanced in the vicinity of a center of the ink channel, and is delayed in the vicinity of a peripheral wall. Therefore, the ink for one pixel is ejected with a time deviation in a portion close to the ink channel inner wall and in a portion far therefrom.

FIG. 22 is a diagram schematically showing image quality deterioration by such phenomenon. In FIG. 22, the image receiving medium (print paper) moves downward (in a direction of an arrowhead), and a plurality of ink ejection ports (four ports in this example) are arranged in a horizontal direction (direction crossing at right angles to the arrowhead).

In this case, with movement of the image receiving medium in the arrowhead direction, the ink for each pixel is adjusted beforehand to provide a predetermined density (and/or color), but with the ink flowing in the ink channel, a flow velocity in the portion in contact with the inner wall of the ink channel becomes slow, and in the portion apart from the inner wall the flow velocity becomes fast. The ink has viscosity, and a flow velocity distribution therefore forms a substantial rotation parabolic surface when the ink channel has a circular section.

Therefore, a state of the ink ejected for a certain pixel can be divided to the following three stages. First, in a first stage (shown by A in FIG. 22), a part of image forming ink (colored ink) is carried by a fast flow in the vicinity of the center of the ink channel, while diffused in an image non-forming ink (clear ink) to be thinned. In a second stage (shown by B), a normal amount of image forming ink enters, and a correct density (and/or color) is obtained. In a third stage (similarly shown by C) after supply of the image forming ink stops, the ink in the vicinity of the inner wall of the ink channel is delayed and ejected.

As a result, one pixel density (color) is blurred forward and backward in parallel with a moving direction of the image receiving medium, and the image quality is deteriorated. Moreover, it can also be said that the delay until image forming ink reaches the ink ejection port changes with a position in a diametric direction of the ink channel, and therefore a rise and fall of density (color) change at the ink ejection port fail to become sharp.

SUMMARY OF THE INVENTION

The present invention has been accomplished in consideration of the aforementioned circumstances, and an object thereof is to provide an image forming method for producing a recording liquid having a desired density and/or color by mixing an image non-forming liquid with one type or a plurality of types of image forming liquid having different densities and/or colors and transferring the recording liquid to an image receiving medium to form an image thereon.

Another object of the present invention is to provide an image forming method which prevents the recording liquid from being disordered before reaching the image receiving medium and which can prevent deterioration of an image quality.

Further object of the present invention is to provide an image forming method in which the recording liquid is transferred to the image receiving medium without being disordered by a recording head simple in structure and high in reliability, and the image quality can be enhanced.

Still another object of the present invention is to provide an image forming method which prevents occurrence of blur of pixel density (or color) in a pre-mix mode and which can enhance the image quality.

Moreover, an object of the present invention is to provide an image forming apparatus for producing a recording liquid having a desired density and/or color by mixing an image non-forming liquid with an image forming liquid and transferring the recording liquid to an image receiving medium to form an image thereon.

Another object of the present invention is to provide an image forming apparatus which prevents a laminar flow structure of the image non-forming liquid and image forming liquid in the recording liquid from being disordered before reaching the image receiving medium and which can prevent deterioration of the image quality.

Further object of the present invention is to provide an image forming apparatus in which the recording liquid is transferred to the image receiving medium without being disordered by a recording head simple in structure and high in reliability, and the image quality can be enhanced.

Still another object of the present invention is to provide an image forming method which prevents occurrence of blur of pixel density (or color) in the pre-mix mode and which can enhance the image quality.

In one aspect of the present invention, there is provided an image forming method for forming an image on an image receiving medium with a recording liquid which includes an image forming liquid for finally forming an image and an image non-forming liquid for forming no image after image formation, a mixing ratio of the image forming liquid and the image non-forming liquid being varied based on an image signal, said method comprising steps of:

a) allowing said image non-forming liquid to flow in a recording liquid channel to an ejection port;

b) supplying said image forming liquid into said image non-forming liquid flowing in said recording liquid channel to form said recording liquid so that the image forming liquid in the recording liquid is prevented from contacting an inner wall surface of said recording liquid channel;

c) delivering said recording liquid to the ejection port; and d) ejecting said recording liquid from the ejection port to the image receiving medium to form the image thereon.

In the image forming method of the present invention, the image forming liquid is ejected or extruded into the flow of the image non-forming liquid so that the image forming liquid fails to contact the inner wall of the recording liquid channel. The image forming liquid can be transferred to the image receiving medium in a wrapped or enveloped state in the image non-forming liquid, the image forming liquid is prevented from being disordered before reaching the image receiving medium, and the image quality can be prevented from being deteriorated.

The image non-forming liquid is a liquid by which substantially no image is formed after the image formation (i.e., after application of the recording liquid). Examples of the liquid include a liquid which substantially becomes transparent after dried out, an ultraviolet-curing liquid which substantially becomes transparent after cured, a liquid which is cured by thermal or chemical reaction and substantially becomes transparent, a liquid which evaporates after the image formation and substantially disappears, and the like. Here, this image non-forming liquid will also be referred to simply as the clear liquid or clear ink.

The image non-forming liquid flows as a laminar flow in a recording liquid channel, while the image forming liquid is extruded into the laminar flow entirely as it is as possible, and the image forming liquid enclosed in the clear liquid may be led to a recording liquid ejection port. The image forming liquid can be extruded in a direction substantially crossing at right angles to the flow of the clear liquid, or can be extruded with inclination toward a flow direction or in parallel with a flow direction.

The image forming liquid may be of one color, or the plural image forming liquid having different colors may be extruded into a common clear liquid (image non-forming liquid) so that the color as well as the density can be varied. The image forming liquid is preferably extruded to reach the vicinity of a center of the recording liquid channel, but when the liquid is extruded to a position apart from the inner wall of the recording liquid channel by at least 4 $\mu$m, the image forming liquid enveloped with in the clear liquid smoothly moves without contacting the inner wall. A continuous coating mode is preferable in which for the recording liquid the image forming liquid enveloped in the clear liquid is continuously transferred to the image receiving medium. However, this method can also be applied to an ink jet mode. in which the recording liquid (image forming liquid wrapped in the image non-forming liquid) is jetted flied as a liquid droplet and transferred to the image receiving medium.

In a preferred embodiment, a viscosity of the image non-forming liquid is set to be smaller than that of the image forming liquid. Thereby, the recording liquid flowing in the recording liquid channel is led to the recording liquid ejection port as the laminar flow such that the image forming liquid fails to contact the inner wall of the recording liquid channel.

In order to obtain the flow in the recording liquid channel as the laminar flow, Reynolds number in this flow channel system may be set to 100 or less. When the recording liquid channel is linear, the recording liquid easily flows straight as a stable laminar flow, and the image forming liquid (colored ink) may be added midway. To lower the viscosity of the image non-forming liquid, a substance having low viscosity may of course be selected, but there is also a method of mixing a fine bubble in this ink (image non-forming liquid) to lower an apparent viscosity.

The inventors have known as an experiment result that when the value P defined by the following equation results in 81 $mm^{-1}$ or more, the image quality considerably becomes satisfactory, and when the value P results in 195 $mm^{-1}$ or more, the image quality further becomes satisfactory:

$$\frac{n+(h^2-1)}{nL}=P$$

where, h=R/Ri; n=$\mu$c/$\mu$i; R is an apparent diameter of recording liquid channel (unit: m); Ri is an apparent flow diameter of the image forming liquid (unit: m); and $\mu$c and $\mu$i is fluid viscosities of the image non-forming liquid and the image forming liquid, respectively (unit: pascal·second (Pa·sec)). Moreover, L denotes a distance (unit: mm) from a confluent position of the image forming ink until the ink is detached from an ink ejection port.

In another aspect of the present invention, there is provided an image forming apparatus for forming an image on an image receiving medium with a recording liquid which includes an image forming liquid for finally forming an image and an image non-forming liquid for forming no image after image formation, a mixing ratio of the image forming liquid and the image non-forming liquid being varied based on an image signal, said apparatus comprising:

an ejection port for ejecting said recording liquid onto the image receiving medium;

a recording liquid channel for delivering the image non-forming liquid to said ejection port;

an extruding port for extruding the image forming liquid into the image non-forming liquid to form said recording liquid, said extruding port being disposed apart from an inner wall of the recording liquid channel through which said image non-forming liquid flows and opened in a flow of the image non-forming liquid; and an image forming liquid channel for supplying the image forming liquid to said extruding port.

According to the present image forming apparatus, the image forming liquid enveloped in the image non-forming liquid is transferred to the image receiving medium. An image non-forming liquid ejection port for preventing the image forming liquid from directly contacting the recording head does not have to be separately disposed on the recording head, and the structure of the recording head can be simplified. Therefore, the recording head can be miniaturized and the reliability can be enhanced.

The image forming liquid extruding port may be opened on a tip end of a projection disposed on the inner wall of the recording liquid channel. In such construction, the extruding port may be opened in a vertical direction or obliquely toward a downstream direction with respect to the flow direction of the image non-forming liquid. This projection may be formed in a cylindrical shape, an elliptical shape, a vessel or ship bottom shape, and other various shapes, but is preferably formed so that the flow of the image non-forming liquid fails to be disordered.

The image forming liquid may be extruded or introduced parallel to the flow direction of the image non-forming liquid. For example, the image non-forming liquid is ejected from an end surface of one end opposite to the ejection port of the recording liquid channel, and the image forming liquid is extruded from the vicinity of the center of the end surface to be joined with the image non-forming liquid. The color and density of the recording liquid may be adjusted by adding a plurality of image forming liquids into the common image non-forming liquid and changing the mixture proportion thereof.

In further aspect of the present invention, there is provided an image forming apparatus for forming an image on an image receiving medium with a recording liquid which includes an image forming liquid for finally forming an image and an image non-forming liquid for forming no image after image formation, a mixing ratio of the image forming liquid and the image non-forming liquid being varied based on an image signal, a viscosity of the image non-forming liquid being smaller than the viscosity of the image forming liquid, said apparatus comprising;

a recording liquid channel for delivering the recording liquid to said ejection port, the image non-forming liquid and the image forming liquid being joined in the recording liquid channel to form the recording liquid as a laminar flow to said ejection port;

means for supplying the image non-forming liquid to said recording liquid channel on an upstream side from a confluent position of the image non-forming liquid and the image forming liquid;

an image forming liquid extruding port disposed apart from a wall surface of said recording liquid channel and opened in the image non-forming liquid; and means for supplying the image forming liquid to the image forming liquid extruding port.

By separately providing supply systems of the image forming liquid and image non-forming liquid with flow rate control valves, supply amounts of the respective liquids may be controlled. It is preferable to form the recording liquid channel in a substantially vertically straight line with respect to an opening surface of the recording liquid ejection port, and to dispose the image forming liquid extruding port on a tip end of a projection protruded from the inner wall of the recording liquid channel. With such arrangement, the linear recording liquid channel forms a stable laminar flow, and the recording liquid can smoothly be transferred to the image receiving medium from the recording liquid ejection port.

Distance L, which is a distance between a position where the image forming liquid is joined to the image non-forming liquid and a position where the joined recording liquid is detached from the recording liquid ejection port, is preferably set to be as small as possible. When this distance L is large, a laminar flow state is easily collapsed during movement of the recording liquid along the distance L, and a phase difference between the image forming liquid and image non-forming liquid at the position of the recording liquid ejection port is enlarged by ink viscosity. Moreover, mixture by diffusion between both liquids (inks) also proceeds. This deteriorates the image quality.

The distance L may be determined by considering the flow velocity of the ink (image forming liquid and image non-forming liquid), and other conditions. For example, the ink flow velocity and distance L have to be set with respect to the same image signal in such a manner that the phase difference in the recording liquid ejection port between the image forming liquid and the image non-forming liquid becomes sufficiently small. It is preferable to set the ink flow velocity and distance L in such a manner that the phase difference is 20 $\mu$m or less. In this case, since the image forming liquid and image non-forming liquid with a small phase difference with respect to the same image signal can be led to the recording liquid ejection port, the image quality can further securely be prevented from being deteriorated.

In still further aspect of the present invention, there is provided an image forming method for ejecting an image non-forming ink for finally forming no image and an image forming ink for finally forming an image from an ink ejection port by changing a mixture proportion based on an image signal, and transferring the inks to an image receiving medium to form the image thereon, said method comprising steps of:

setting a viscosity of said image non-forming ink to be smaller than a viscosity of said image forming ink;

joining said image forming ink to said image non-forming ink midway in an ink channel for feeding said image non-forming ink as a laminar flow to the ink ejection port so that said image forming ink is prevented from contacting an inner wall of said ink channel; and delivering the inks as the laminar flow to the ink ejection port.

In the present invention, the image formed on the image receiving medium includes graphical intelligence patterns such as alphanumeric characters, graphical display, line art, circuit pattern and other image information.

DETAILED DESCRIPTION OF THE PREFERRED EMBODIMENTS

First Embodiment

Figure 1:
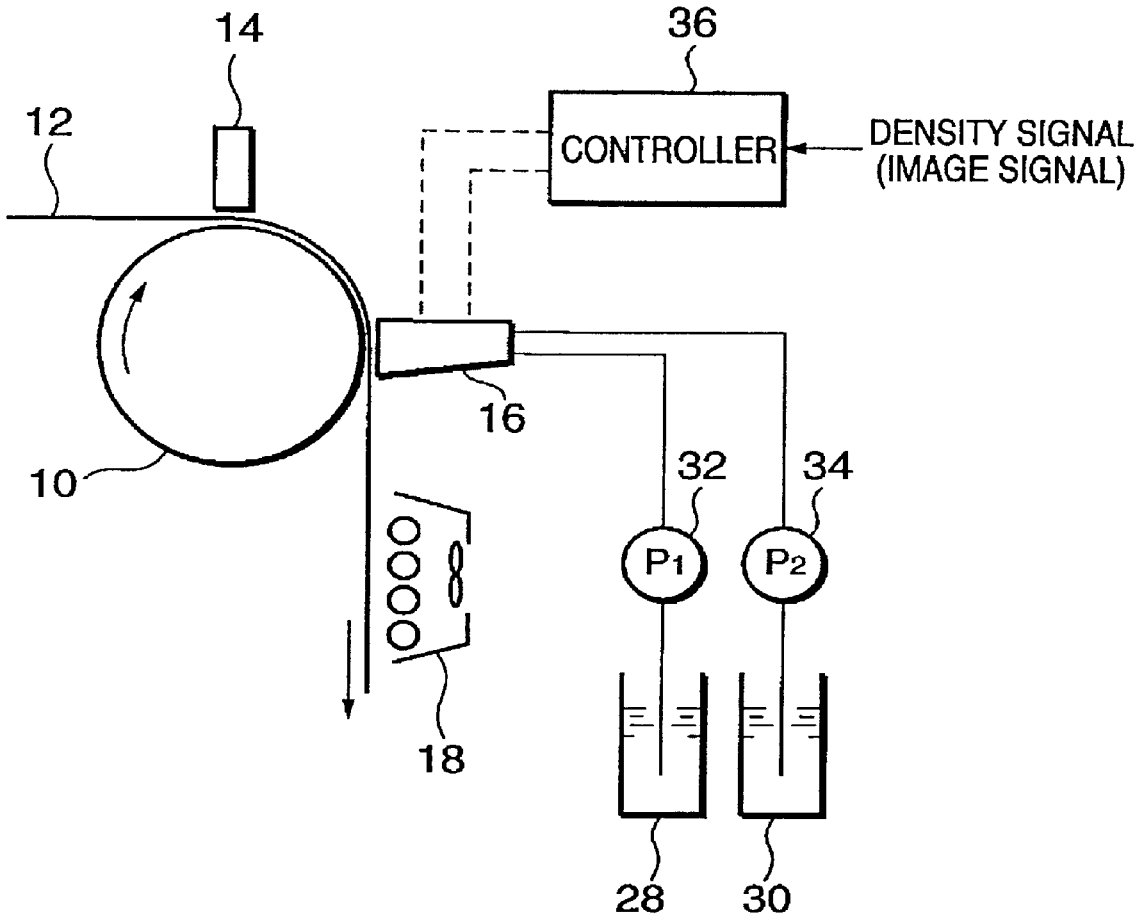
FIG. 1 is a view showing a concept of an image forming apparatus according to a first embodiment of the present invention to which a continuous coating mode is applied.

An image forming apparatus of a continuous coating mode according to one embodiment of the present invention will be described with reference to FIGS. 1 to 4. In FIG. 1, reference numeral 10 denotes a platen and 12 denotes a print paper as an image receiving medium wound around the platen 10. The print paper 12 is fed in a direction of an arrowhead at a fixed speed by illustrative clockwise rotation of the platen 10.

Reference numeral 14 represents an undercoating section for applying an undercoating liquid onto the print paper 12 in order to enhance the adherability of ink and improve image quality. When a clear liquid described later also serves as an undercoating liquid function, the undercoating section 14 can be omitted. Reference numeral 16 is an image forming section (hereinafter referred to also as an ink ejection head or a recording head). The clear liquid (image non-forming liquid: hereinafter referred to also as an image non-forming ink or a clear ink) is mixed with an image forming liquid (hereinafter referred to also as an image forming ink or a colored ink) in the recording head 16 and led to the print paper 12 to form an image on the print paper 12. Reference numeral 18 denotes a heater for heating the print paper 12 on which the image is formed by the recording head 16 so that the ink is dried out.

Figure 2:
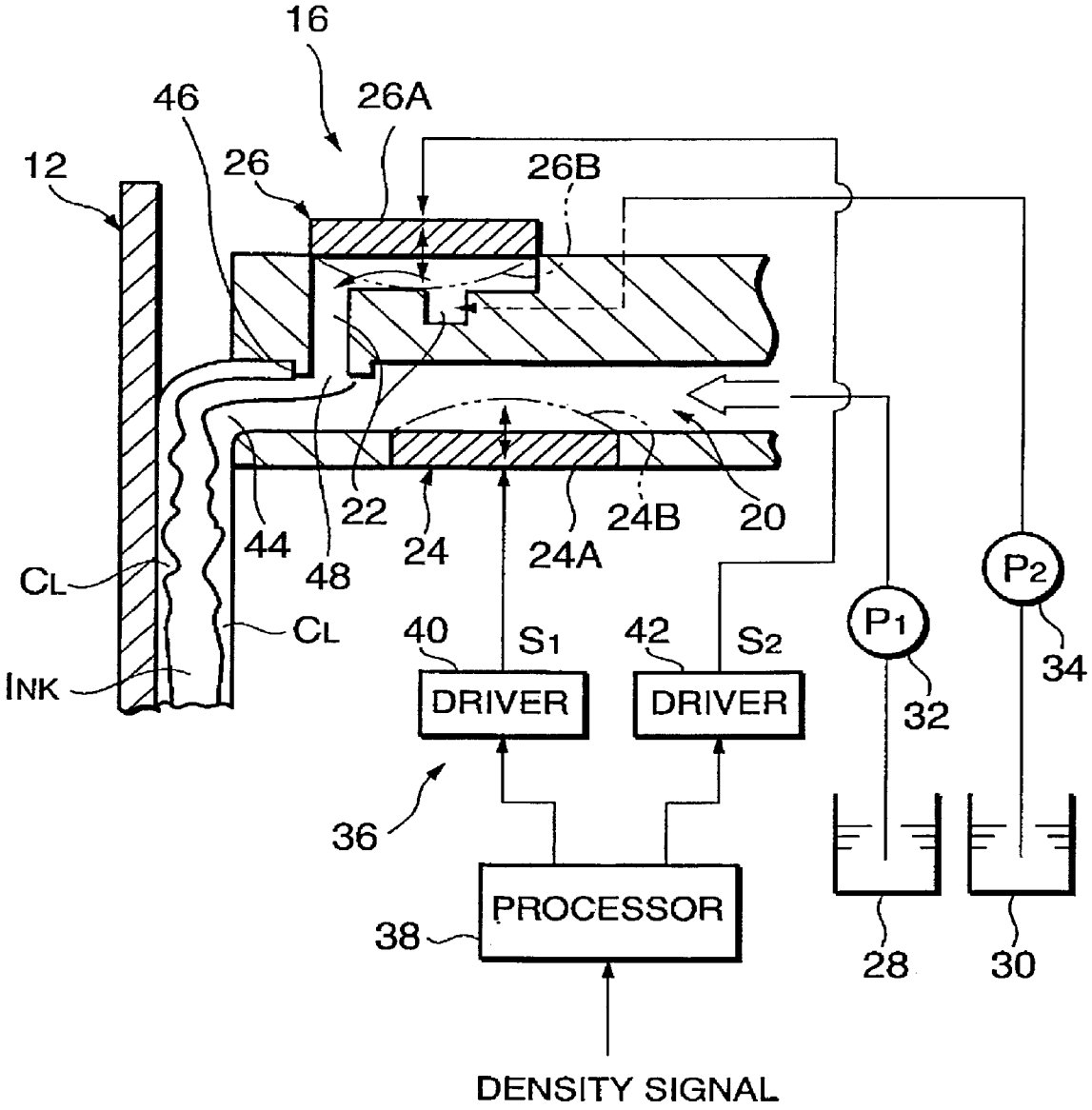
FIG. 2 is an enlarged sectional view of an image forming section (recording head) for use in the image forming apparatus illustrated in FIG. 1.

As shown in FIG. 2, the recording head 16 includes: a recording liquid channel 20; an ink channel (image forming liquid channel) 22; and flow rate control valves 24, 26 as ink flow rate controlling means for changing channel cross section areas of the respective channels 20, 22. Clear liquid $C_L$ flows in the recording liquid channel 20. The clear liquid $C_L$ is a colorless and transparent ink or becomes colorless and transparent when dried out. The clear liquid $C_L$ contains a decoloration preventing agent such as antioxidant or ultraviolet ray absorber. Image forming liquid $I_{NK}$ for finally forming an image flows in the ink channel 22. The image forming liquid $I_{NK}$ is, for example, a black ink.

The clear liquid $C_L$ and image forming liquid $I_{NK}$ are respectively contained in ink tanks 28, 30, and fed to the recording liquid channel 20 and ink channel 22 with a fixed pressure from the ink tanks 28, 30 by ink feed pumps 32, 34. Suitable examples of pumps 32, 34 include an air pump for applying a fixed pneumatic pressure to the sealed ink tanks 28, 30, or a pump provided with a structure in which a pressure control valve is disposed on an ink discharge side to maintain the ejection pressure to be constant.

Flow rate control valves 24, 26 include, for example, piezoelectric devices 24A, 26A and diaphragms 24B, 26B which move into/from the respective channels 20, 22 by distortion of the devices 24A, 26A, respectively. These piezoelectric devices 24A, 26A are controlled by a controller 36 (FIG. 1) in such a manner that a total supply amount $S_0$ of the clear liquid $C_L$ and image forming liquid $I_{NK}$ supplied from the respective channels 20, 22 is always constant.

The controller 36 includes a processor 38 and drivers 40, 42 as shown in FIG. 2. The processor 38 calculates a mixture proportion ($S_1/S_2$) of the clear liquid $C_L$ and image forming liquid $I_{NK}$ based on a density signal (image signal). Supply amounts $S_1$ and $S_2$ of the clear liquid $C_L$ and image forming liquid $I_{NK}$ are determined so that the sum ($S_1+S_2$) becomes a fixed amount $S_0$. The drivers 40 and 42 drive the piezoelectric devices 24A and 26A in order that the supply amounts from the respective channels 20 and 22 become $S_1$ and $S_2$, respectively.

For example, the piezoelectric devices 24A and 26A are driven by a pulse having a mechanical resonance frequency inherent to the device, and the pulse number controls a number of times of opening/closing the diaphragms 24B and 26B, thereby controlling flow rates $S_1$ and $S_2$. In this case, if the channel resistance of the channels 20 and 22, the ink feed pressure, a condition for opening/closing the diaphragms 24B and 26B, and the like are satisfied, a total flow rate $S_0=S_1+S_2$ can be managed to be constant by controlling in such a manner that a sum of the pulse number for driving the piezoelectric devices 24A and 26A becomes a fixed value.

The clear liquid $C_L$ and image forming liquid $I_{NK}$ whose flow rates are controlled are ejected as a continuous flow from a recording liquid ejection port 44 at which the channels 20 and 22 become confluent, and continuously applied on the print paper 12 opposite to the ejection port 44. In this case, the image forming liquid $I_{NK}$ is ejected or extruded into the clear liquid $C_L$ from the ink channel 22 in a substantially vertical direction with respect to the flow direction of the clear liquid $C_L$ in the recording liquid channel 20.

Figure 3:
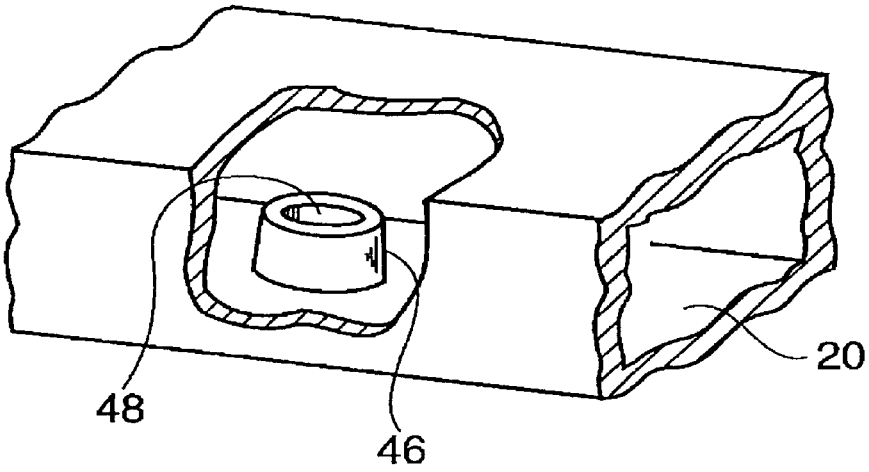
FIG. 3 is a partially sectional perspective view showing one recording liquid channel of the image forming section of FIG. 2.

Specifically, a cylindrical projection 46 is formed on the inner wall of the recording liquid channel 20, the ink channel 22 is opened in the top surface of the projection 46, and the opening forms an image forming liquid extruding port 48 (FIG. 3). The projection 46 is protruded from the inner wall of the recording liquid channel 20 by at least 5 $\mu$m. Therefore, the image forming liquid $I_{NK}$ wrapped or enveloped in the clear liquid $C_L$ is led to the recording liquid ejection port 44 without contacting the inner wall of the recording liquid channel 20 or being disordered in flow.

As shown in FIG. 2, the clear liquid $C_L$ and image forming liquid $I_{NK}$ are applied as a layer or laminar flow with no disorder and without being easily mixed with each other. Here the laminar flow includes a flow in a mixed state only in the vicinity of a boundary of the clear liquid $C_L$ and image forming liquid $I_{NK}$. By applying the image forming liquid $I_{NK}$ as the laminar flow in this manner, the image forming liquid $I_{NK}$ can be led to the print paper 12 without contacting the inner wall of the recording liquid channel 20 in the recording head 16, and the image can be prevented from being disordered.

Figure 4A:
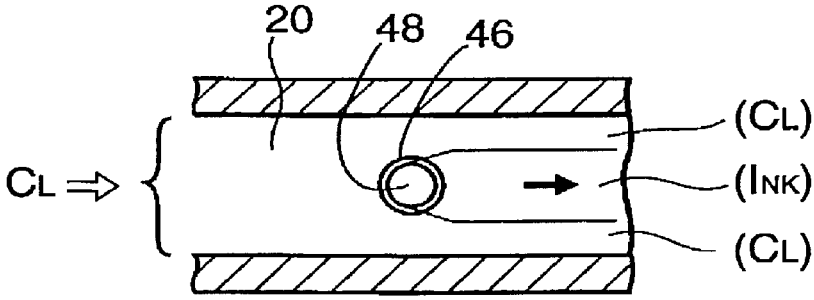
FIGS. 4A, 4B, 4C are a sectional plan view, a sectional side view, and a sectional front view, respectively, of the recording liquid channel of FIG. 3.
Figure 4B:
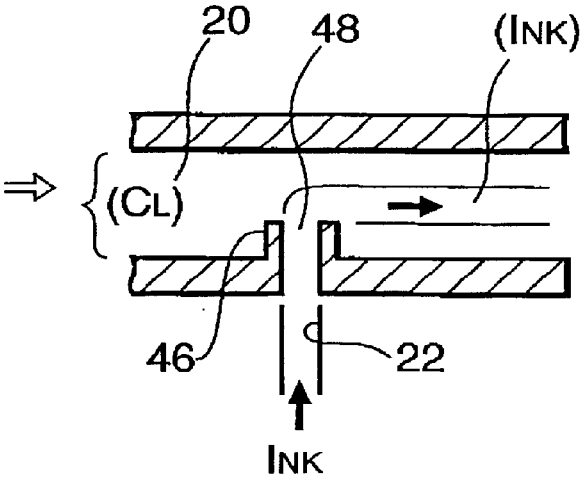
Figure 4C:
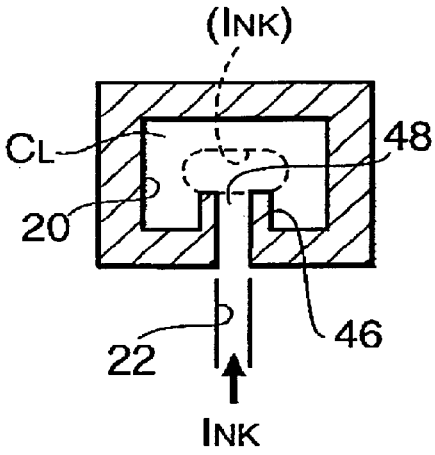

Moreover, since the surface of the image formed on the print paper 12 is covered with the clear liquid, $C_L$ the printed surface forms a uniform lustrous surface, and provides a favorable image quality. Moreover, the clear liquid $C_L$ can function as the undercoating layer of the print sheet 12. Additionally, FIGS. 4A, 4B, 4C is a sectional plan view, a sectional side view, and a sectional front view of the recording liquid channel 20, respectively.

The channels 20, 22 of the clear liquid $C_L$ and image forming liquid $I_{NK}$ and the flow rate control valves 24, 26 constitute one nozzle unit. When a multiplicity of nozzle units are provided to be aligned in a width direction of the print paper 12 (direction orthogonal to the moving direction of the print paper) and they are disposed for respective pixels, the image can be formed by controlling the flow rate control valves 24, 26 for the respective pixels in accordance with respective density signals (image signals). In this case, the recording liquid ejection port 44 independent for each pixel can be disposed opposite to the print paper 12. Further, the recording liquid ejection ports 44 can be formed in a slot-shaped opening elongating in the width direction of the print paper 12, and the recording liquid including the clear liquid $C_L$ and image forming liquid $I_{NK}$ can be transferred and applied onto the print paper 12 from this slot opening in a strip form.

Second Embodiment

Figure 5:
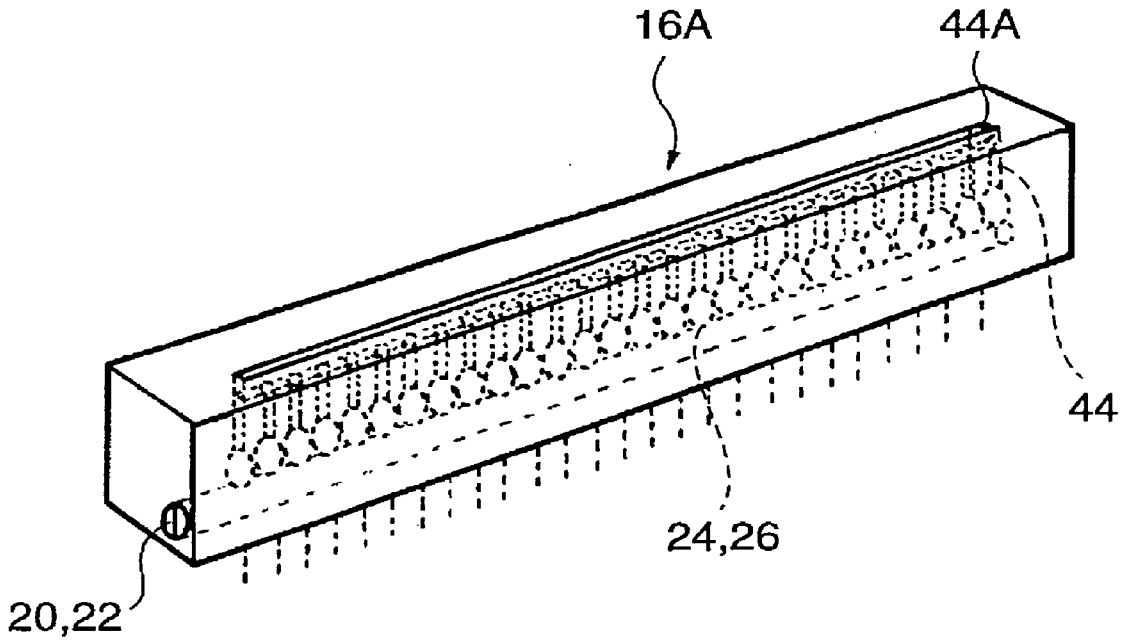
FIG. 5 is a partially sight through perspective view of the image forming section (recording head) used in the image forming apparatus according to a second embodiment of the present invention to which a slot coating mode is applied.

FIG. 5 is a perspective view showing an image forming section (recording head) 16A used in a second embodiment for performing the continuous zonal application as described above, and FIG. 6 is an enlarged cross-sectional view showing the state of application. The recording head 16A includes recording liquid ejection ports 44 which are independent in accordance with respective pixels and a slot opening 44A which is in parallel with the ink ejection ports 44 for the respective pixels, and the recording liquid continuously ejected from each recording liquid ejection port 44 zonally congregates as a layer flow in the slot opening 44A to be ejected or extruded on the print paper 12.

Since the recording liquid ejected from each recording liquid ejection port 44 is constituted by wrapping the image forming liquid $I_{NK}$ in the clear liquid $C_L$, the clear liquid $C_L$ has a function of connecting the respective recording liquids during congregation in the slot 44A, and no disorder of the image forming liquid $I_{NK}$ occurs. Therefore, no deterioration of image quality is caused.

Figure 6:
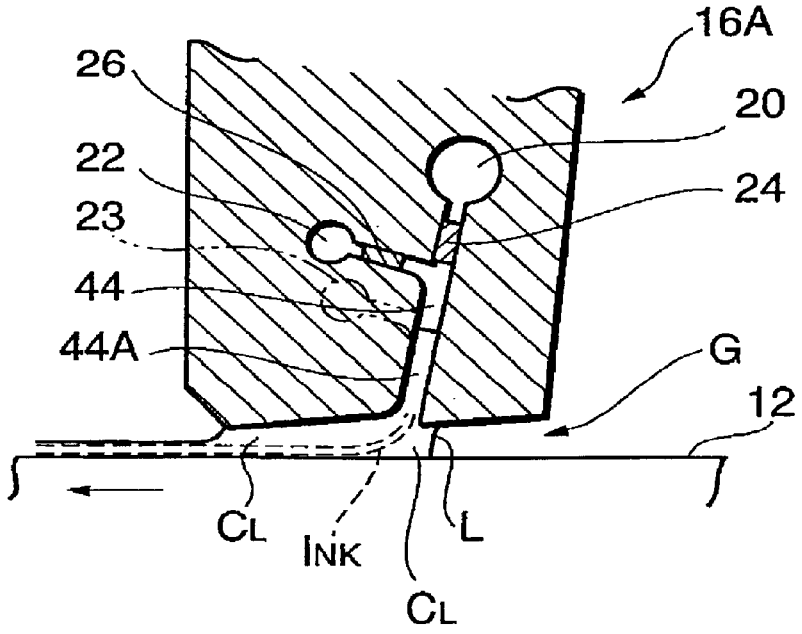
FIG. 6 is an enlarged sectional view showing a coating state by the recording head of FIG. 5.

The clear liquid $C_L$ also has a function of preventing turbulence or whirlpool from being generated in the flow of the image forming liquid $I_{NK}$ during continuous application of the recording liquid and improving the image quality. Specifically, as shown in FIG. 6, the clear liquid $C_L$ wrapping the outside of the recording liquid ejected from the slot 44A flows to the upstream side of the slot 44A to form a liquid pool or bead L in a gap G formed between the recording head 16A and the print paper 12. A whirlpool of the clear liquid. $C_L$ may be generated in the liquid pool L, but this does not adversely affect the coating surface and fails to deteriorate the image quality because the liquid is transparent.

The liquid pool L formed by the clear liquid $C_L$ comes in front of the slot 44A as a stable laminar flow having a fixed thickness in consequence with movement of the print paper 12. Accordingly, the image forming liquid $I_{NK}$ ejected from the slot 44A is loaded onto the laminar flow of the stable clear liquid $C_L$ to be applied. Therefore, the image quality can be improved without generating any distortion or whirlpool in the flow of the image forming liquid $I_{NK}$.

Another ink channel 23 may be disposed in the recording head 16A. Another image forming liquid $I_{NK}$2 supplied from the ink channel 23 is led to the recording liquid ejection port 44 through a flow control valve (not shown), and transported to the print paper 12 together with the image forming liquid $I_{NK}$ in the clear liquid $C_L$. When two ink channels 23 are provided, color inks of yellow, magenta and cyan are supplied to the ink channels 22, 23 and 23, respectively, and a mixture ratio of the color inks is varied, thus enabling formation of a color image.

Third Embodiment

Figure 7:
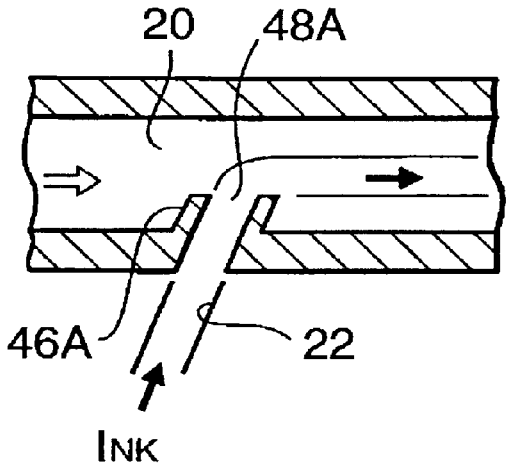
FIG. 7 is a sectional view of a recording liquid channel of the image forming section according to a third embodiment of the present invention.

FIG. 7 is a sectional view showing a third embodiment. In the embodiment, an inclined cylindrical projection 46A inclined on the downstream side in the flow direction of the clear liquid $C_L$ is disposed in the inner wall of the recording liquid channel 20, and an outlet port 48A of the ink channel 22 is opened in the top surface of the projection 46A. This ink extruding port 48A is inclined and opened in the flow direction of the clear liquid $C_L$. Therefore, the image forming liquid $I_{NK}$ smoothly enters the clear liquid $C_L$, and disorder is not easily generated.

Fourth Embodiment

Figure 8A:
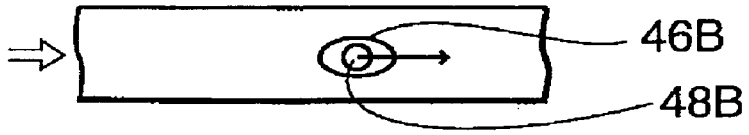
FIGS. 8A, 8B, 8C are plan views showing projections in the recording liquid channel according to a fourth embodiment of the present invention.
Figure 8B:
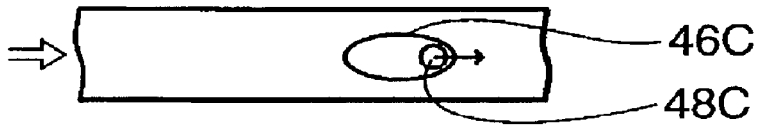
Figure 8C:
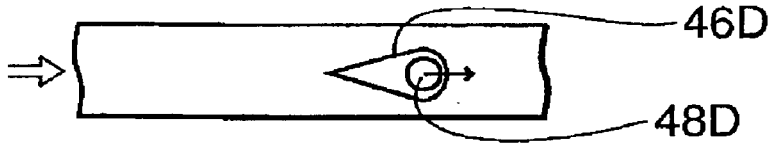

FIGS. 8A–8C are plan views showing other embodiments of the projection. A projection 46B shown in FIG. 8A has an elongated elliptical shape in the flow direction of the clear liquid $C_L$, and an ink extruding or ejection port 48B is opened in the vicinity of the middle of the top surface of the projection. A projection 46C shown in FIG. 8B has an elongated elliptical shape in the flow direction of the clear liquid $C_L$, and an ink ejection port 48C is opened in a downstream end of the top surface of the projection. A projection 46D shown in FIG. 8C has a droplet shape toward a flow downward direction, and an ink ejection port 48D is opened in the downstream end of the top surface of the projection. According to these embodiments, the projections 46B to 46D can further reduce disorder generated in the clear liquid $C_L$.

Fifth Embodiment

Figure 9A:
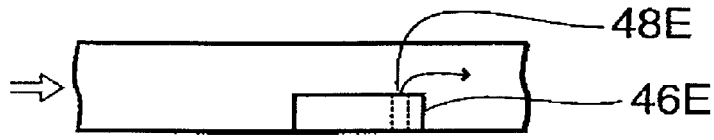
FIGS. 9A, 9B, 9C are side views showing side shapes of the projections in the recording liquid channel according to a fifth embodiment of the present invention.
Figure 9B:
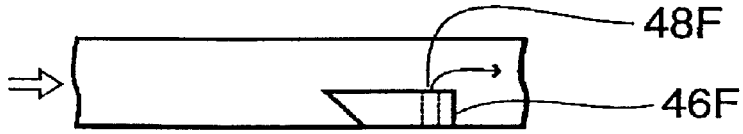
Figure 9C:
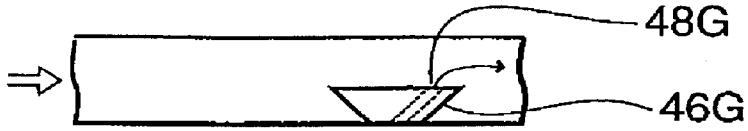

FIGS. 9A–9C are similarly side views of the recording liquid channel 20, and show embodiments of a side surface shape of the projection in the respective embodiments of FIGS. 8A–8C. A projection 48E shown in FIG. 9A is formed in a cylindrical shape in which a sectional shape fails to change along a length direction (projecting direction). For a projection 46F shown in FIG. 9B, an end surface on an upstream side is inclined toward the upstream side. Numerals 48E, 48F denote ink ejection or extruding ports. A projection 46G shown in FIG. 9C has a substantial vessel (ship) bottom shape, and in a top surface, that is, on a deck side, an ink ejection port 48G inclined in a flow downward direction is opened. By devising the shapes of the projections 46E, 46F, 46G in this manner, disorder generated in the clear liquid can further be reduced.

Sixth Embodiment

Figure 10:
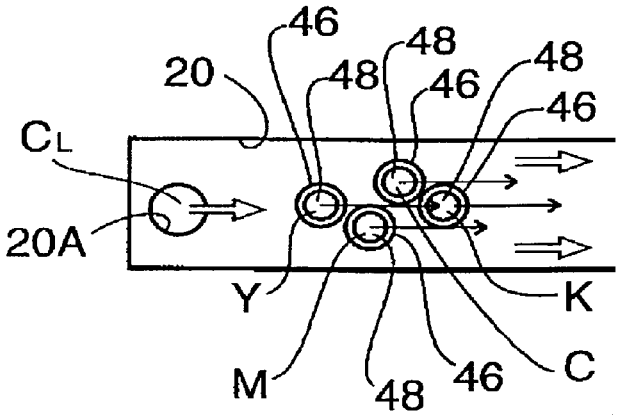
FIG. 10 is a plan view showing an arrangement of image forming liquid extruding ports in the recording liquid channel according to a sixth embodiment of the present invention.

FIG. 10 is a plan view showing a sixth embodiment. In the embodiment, different colors of image forming liquids are extruded into the common recording liquid channel 20. Specifically, a clear liquid feed port 20A is disposed in one end of the recording liquid channel 20, and the laminar flow of the clear liquid $C_L$ is formed in the recording liquid channel 20. Respective inks of yellow (Y), magenta (M), cyan (C) and black (K) are ejected into the clear liquid $C_L$ from ink ejection ports 48 of four projections 46 disposed on the inner wall of the recording liquid channel 20.

According to the embodiment, by controlling ejection amounts of the respective inks based on the image signal, the mixture proportion of the respective inks is changed, and the color image can be formed as a result. Here the respective inks are ejected into the clear liquid $C_L$, no ink adheres to the inner wall of the recording liquid channel 20, and the image quality is enhanced.

Seventh Embodiment

Figure 11:
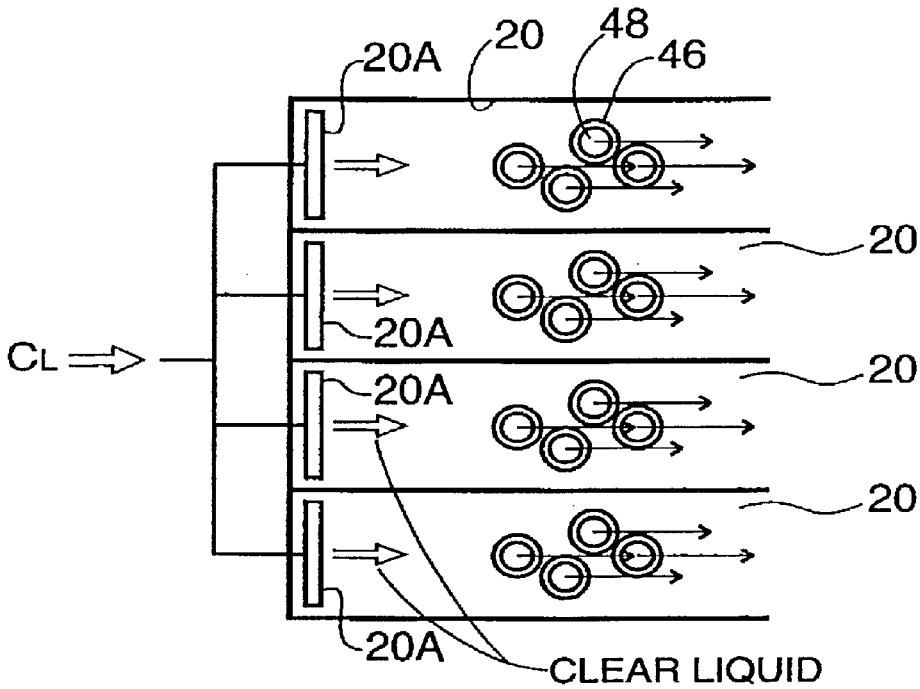
FIG. 11 is a plan view showing the arrangement of the plural recording liquid channels according to a seventh embodiment of the present invention.

FIG. 11 is a view showing a seventh embodiment. In the embodiment, by arranging a plurality of recording liquid channels shown in FIG. 10, color display can be performed based on image signals for respective pixels. In FIG. 11 the clear liquid $C_L$ is supplied to the feed port 20A disposed in one end of each recording liquid channel 20 from a common clear liquid constant pressure supply pump (not shown), and a constant pressure laminar flow of clear liquid is formed in each recording liquid channel 20.

Eighth Embodiment

Figure 12:
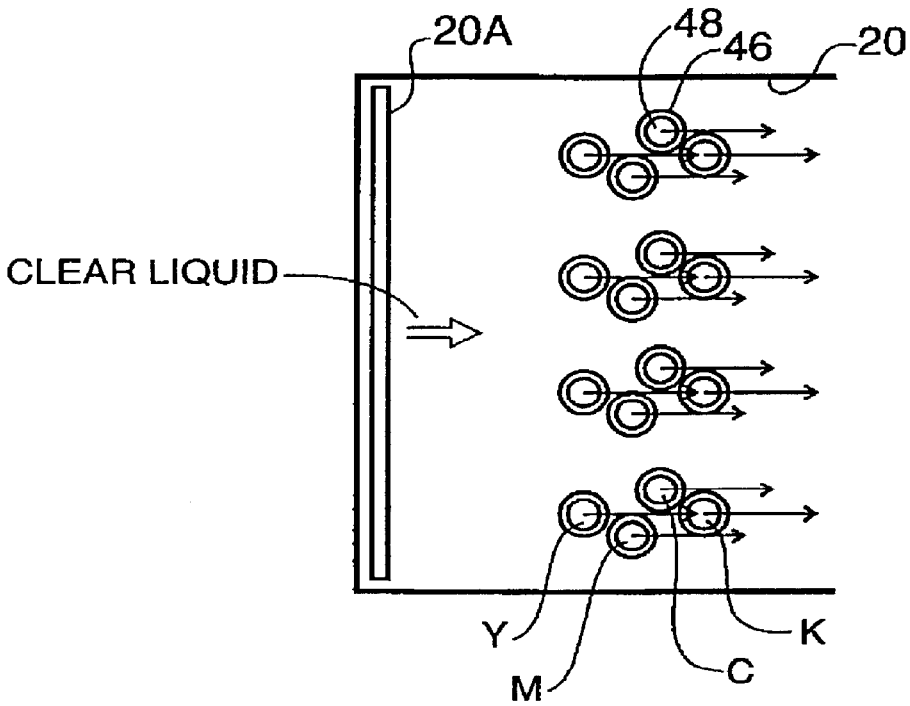
FIG. 12 is a plan view showing the combined recording liquid channel according to an eighth embodiment of the present invention, and shows the recording liquid channel formed on a slot provided with extruding ports for a plurality of colors of inks.

FIG. 12 is a view showing the eighth embodiment. In the embodiment, partition walls of the recording liquid channels 20 disposed for the respective pixels in FIG. 11 are omitted. Specifically, the recording liquid channel 20 is formed in a slot shape, the clear liquid ejection port 20A for forming the uniform laminar flow of the clear liquid with the constant pressure is disposed in one end of the recording liquid channel 20, and the projections 46 and ink ejection ports 48 for four colors are disposed in positions corresponding to the respective pixels. It is preferable to supply the clear liquid from a constant pressure supply source and to supply the image forming liquid from a supply source for supplying a capacity modulated by the image signal. According to the embodiment, the structure of the recording liquid channel 20 is simplified, one clear liquid supply source is sufficient, and manufacture is facilitated.

Ninth embodiment

Figure 13:
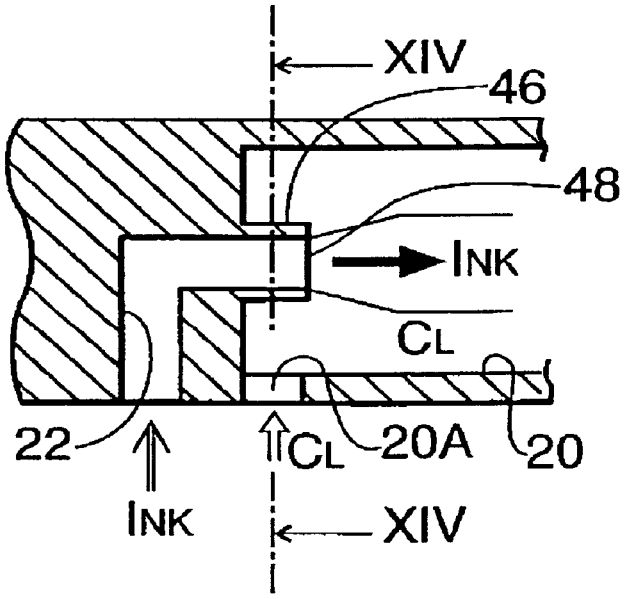
FIG. 13 is a sectional side view showing a structure of the clear liquid inlet port and ink extruding port disposed in the recording liquid channel according to a ninth embodiment of the present invention.
Figure 14:
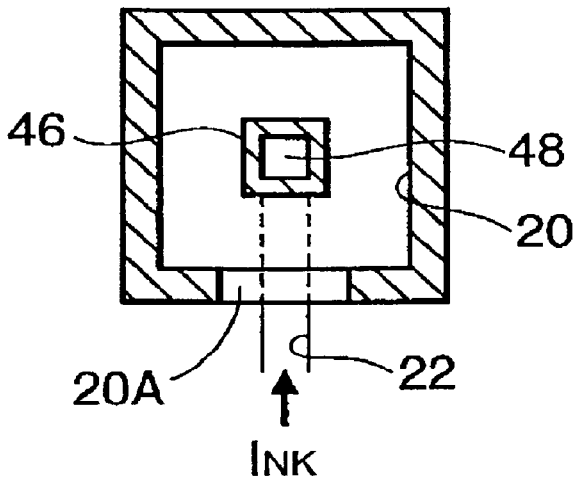
FIG. 14 is a sectional view along a XIV—XIV line of FIG. 13.

FIG. 13 is a sectional side view showing a ninth embodiment, and FIG. 14 is a sectional view along a XIV—XIV line of FIG. 13. In the embodiment, one end of the recording liquid channel 20 having a square cross section is closed, the clear liquid ejection port 20A is opened in the side wall in vicinity of the closed end of the channel 20 and the clear liquid $C_L$ is supplied therefrom to the channel 20. The projection 46 is formed in the center of the closed end to project toward the flow downward direction of the clear liquid $C_L$, and has the ink ejection port 48 is opened to turn to the flow downward direction of the clear liquid.

According to the embodiment, the image forming liquid $I_{NK}$ is securely ejected in the vicinity of the center of the flow of the clear liquid $C_L$, and the image forming liquid $I_{NK}$ can smoothly be led to the image receiving medium without contacting the inner wall of the recording liquid channel 20. This is suitable for enhancing the image quality.

Tenth Embodiment

Figure 15:
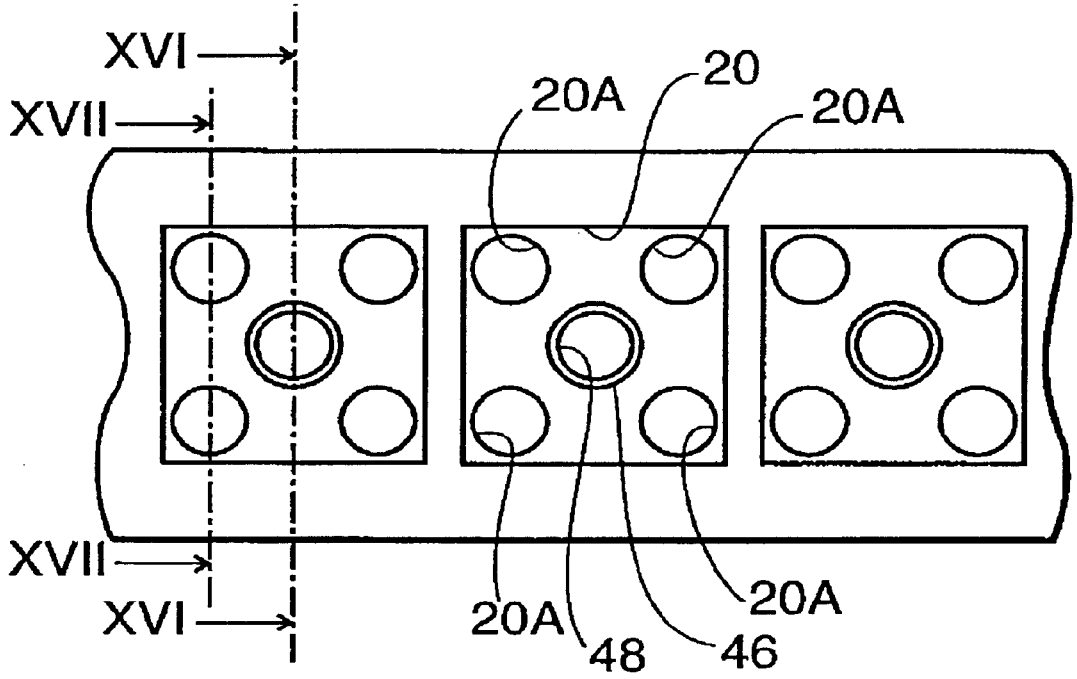
FIG. 15 is a view of the inside of the recording liquid channel seen from the side of the recording liquid ejection port according to a tenth embodiment of the present invention, and shows the arrangement of the clear liquid ejection ports and ink ejection port.
Figure 16:
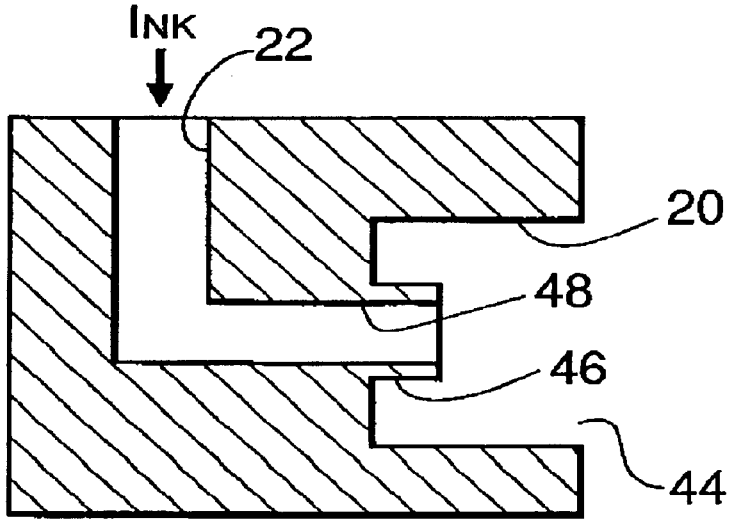
FIG. 16 is a sectional view along a XVI—XVI line of FIG. 15.
Figure 17:
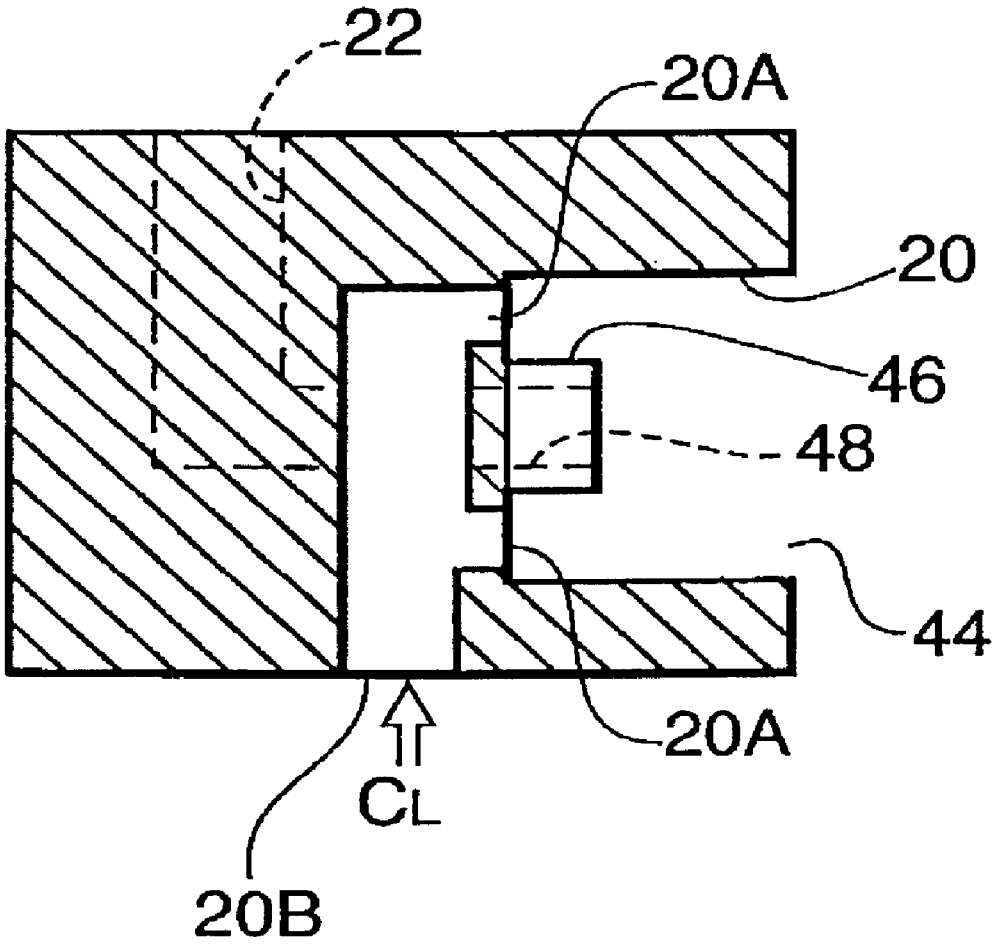
FIG. 17 is a sectional view along a XVII—XVII line of FIG. 15.

FIG. 15 is a view showing a tenth embodiment seen in the recording liquid channel 20 from the side of the recording liquid ejection port 44. FIGS. 16 and 17 are sectional views along XVI—XVI and XVII—XVII lines in FIG. 15.

In the embodiment, the recording liquid channel 20 having a square cross section is disposed for every pixel and one end of the channel 20 is closed. On four corners of the closed end surface of the channel 20, the clear liquid ejection ports 20A directed in a clear liquid flow downward direction are disposed. Moreover, the clear liquid $C_L$ is supplied to each clear liquid ejection port 20A from a clear liquid supply port 20B and a steady flow of the clear liquid $C_L$ is formed in the recording liquid channel 20. On the other hand, one projection 46 is formed in the center of the closed end surface of the recording liquid channel 20, the ink ejection port 48 is opened in parallel with the flow downward direction of the clear liquid $C_L$, and the image forming liquid $I_{NK}$ is supplied from the ink channel 22.

According to the embodiment, the image forming liquid $I_{NK}$ ejected from the ink ejection port 48 is securely surrounded by the clear liquid $C_L$ ejected from four peripheral clear liquid ejection ports 20A, and flows downward together with the clear liquid $C_L$. Therefore, the image forming liquid $I_{NK}$ smoothly flows together with the clear liquid $C_L$, and the image quality is enhanced.

Eleventh Embodiment

Figure 18:
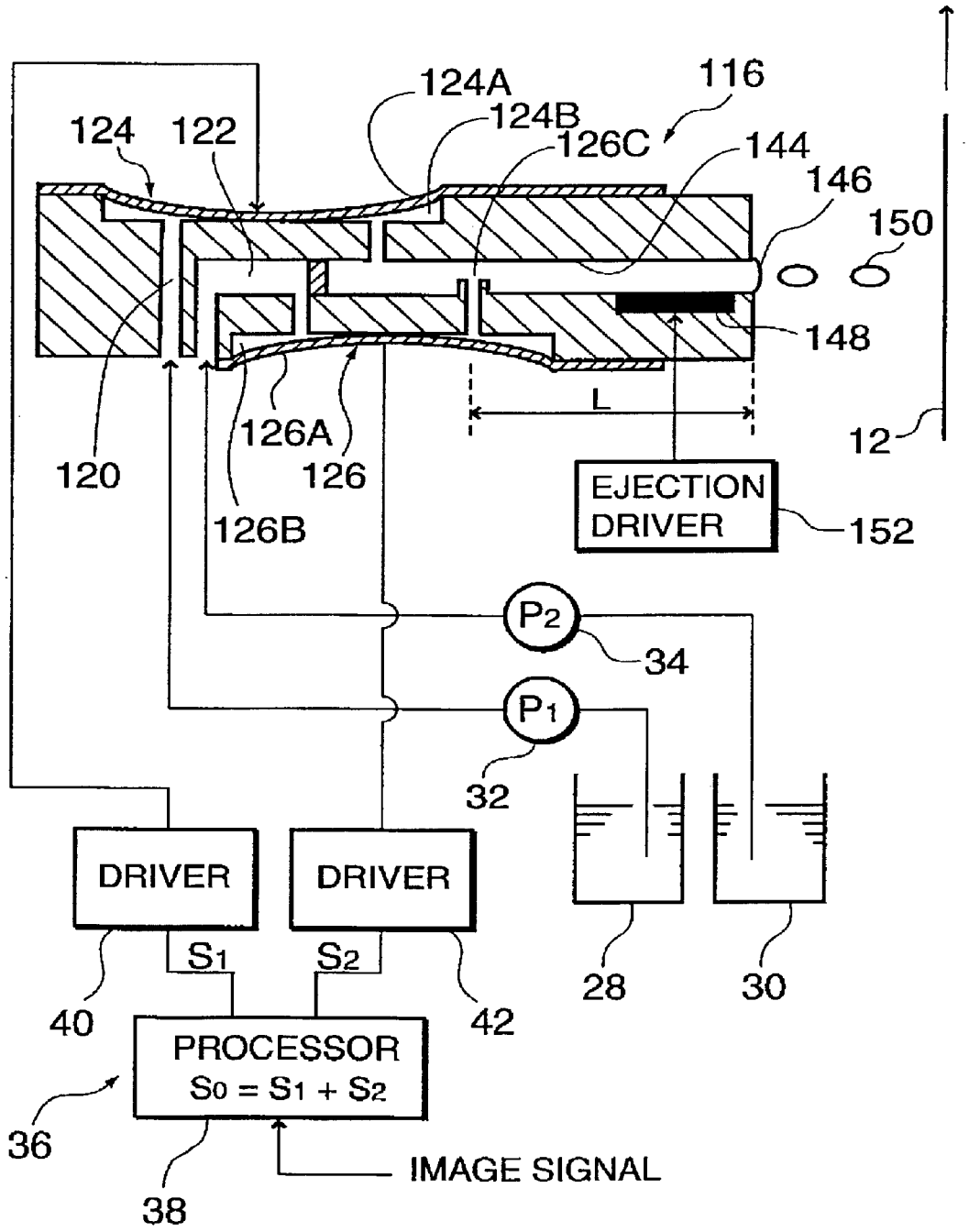
FIG. 18 is an enlarged sectional view of the image forming section (recording head) according to an eleventh embodiment of the present invention to which an ink jet mode is applied.

FIG. 18 is an enlarged sectional view of the image forming section (recording head) for use in the image forming apparatus according to an eleventh embodiment of the present invention. Similarly as the first to tenth embodiments, a recording head 116 is disposed opposite to the platen 10 of FIG. 1, and mixes and leads a first ink (referred to also as the image non-forming ink or the clear ink) and a second ink (referred to also as the image forming liquid or the colored ink) to the print paper 12 as the image receiving medium wound around the platen to form the image on the print paper 12. The ink of the image formed on the print paper 12 is dried by the heater 18. Since the eleventh embodiment is similar to the embodiment shown in FIG. 1 except the image forming section (recording head), the description of sections other than the image forming section (recording head) 116 is omitted.

The ink ejection head (recording head) 116 is of an ink jet mode, and includes, as shown in FIG. 18, a first ink channel 120, a second ink channel 122, and flow control valves 124, 126 as ink flow rate controlling means for changing channel cross section areas of the respective channels 120, 122. The first ink is an image non-forming ink which becomes colorless and transparent to form no image when dried out, and contains decoloration preventing agents such as antioxidant or ultraviolet ray absorber. The second ink is, for example, a black ink or another colored ink to finally form the image.

The first and second inks are respectively contained in the ink tanks 28, 30, and fed to the first and second ink channels 120, 122 with a fixed pressure from the ink tanks 28, 30 by the ink feed pumps 32, 34 as ink supplying means. As the pumps 32, 34 used here, for example, a pump provided with a structure in which a pressure control valve is disposed on an ink discharge side to maintain the ejection pressure to be constant is suitable.

Flow control valves 124, 126 include, for example, diaphragms 24A, 26A which move into/from the ink channels 20, 22 by distortion of the piezoelectric devices, respectively. These piezoelectric devices are controlled by the controller 36 (FIG. 1) in such a manner that the total supply amount So of the first and second inks supplied from the respective ink channels 120, 122 is always constant.

The controller 36 includes the processor 38 and drivers 40, 42 as shown in FIG. 18. The processor 38 calculates the mixture proportion $S_1/S_2$ of the first and second inks based on the density signal (image signal). The supply amounts $S_1$ and $S_2$ of the first and second inks are determined so that the sum $(S_1+S_2)$ becomes a fixed amount $S_0$. The drivers 40 and 42 drive the piezoelectric devices in order that the supply amounts from the respective channels 120 and 122 become $S_1$ and $S_2$.

For example, the piezoelectric devices are driven by the pulse having a mechanical resonance frequency inherent to the device, and the pulse number controls the number of times of opening/closing the diaphragms, thereby controlling the flow rates $S_1$ and $S_2$. In this case, if the channel resistance of the channels 120 and 122, the ink feed pressure, the condition for opening/closing the diaphragms 124A and 126A, and the like are satisfied, the total flow rate $S_0=S_1+S_2$ can be managed to be constant by controlling in such a manner that the sum of the pulse number for driving the piezoelectric devices becomes a fixed value.

Additionally in the eleventh embodiment, the flow rate control valves 124, 126 include cavity portions 124B, 126B whose volumes change with displacement of the diaphragms 124A, 126A. Geometric shapes, and the like of respective portions are set in such a manner that an inflow resistance of the first and second inks flowing into the cavity portions 124B, 126B from the ink feed pumps 32, 34 becomes larger than an outflow resistance of the ink flowing out to an ink channel (recording liquid channel) 144 as a mixture chamber from the cavity portions 24B, 26B.

The ink channel 144 is linear, and one end of the channel is an ink ejection port 146. Additionally, the ink channel 144 is positioned on a straight line vertical to the opening surface of the ink ejection port 146. The first ink flows into the ink channel 144 from the vicinity of the bottom of the ink channel 144, in other words, from the vicinity of the end on the opposite side of the ink ejection port 146. Moreover, an ink ejection port 126C through which the second ink flows out to the ink channel 144 is opened in a tip end of a projection projecting into the ink channel 144 from the inner wall surface of the ink channel 144.

The Reynolds number of the flow system of the ink channel 144 is set to 100 or less as described later, and the first and second inks form the laminar flow in the ink channel 144 and flow toward the ink ejection port 146. Moreover, a viscosity of the first ink (clear ink) is set to be smaller than the viscosity of the second ink (colored ink). A position in which the second ink is confluent with the first ink, that is, the position of the second ejection port 126C may be set in such a manner that the distance L to the ink ejection port 146 is minimized. When the distance L is small, the laminar flow of the first and second inks is prevented from being disordered in the distance L, the phase difference in the ink ejection port of both inks can be prevented from being enlarged, and both inks can be prevented from being mixed by diffusion.

In order to prevent both inks from being mixed by diffusion, properties of solvents of both inks may be set such that the solvents are not easily mixed with each other. Moreover, when the velocity distribution of the second ink becomes slow outside a radial direction by the viscosity, the phase difference between the second ink and the first ink in the ink ejection port 146 may be set to be sufficiently small. In this case, the image quality deterioration by the viscosity of both inks can be inhibited.

By setting the viscosity and properties of the first and second inks, and setting the distance L to be sufficiently small, the-second ink is ejected into the flow of the first clear ink without adhering to the inner wall of the ink channel 144, and subsequently led to the ink ejection port 146 in a maintained laminar flow state and a wrapped or enveloped state in the first ink. Moreover, the phase difference between both inks in the ink ejection port 146 can sufficiently be reduced. An ink droplet 150 is ejected from the ink ejection port 146 by a heater 146 as ink droplet ejecting means, and the ink droplet 150 flies to the print paper 12 to form the image on the print paper 12.

The heater 148 as the ink droplet ejecting means is disposed on the inner surface of the ink channel 144. Specifically, the heater 148 is positioned on a plane parallel to an opening direction (ink droplet flying direction) of the ink ejection port 146. The heater 148 generates heat by an ejection driver 152. By the heat generation the ink in contact with the heater 148 is heated and subjected to nucleate boiling, and in this case the ink is ejected as the liquid droplet from the ink ejection port 146 by the pressure generated by volume expansion.

Specifically, the embodiment is of a so-called side shooter type in which the ink droplet ejection direction crosses at right angles to an ejection force application direction (direction vertical to the surface of the heater 148) by the heater 148. However, the invention may be of a so-called roof-shooter type (or a top-shooter type) in which the ink droplet ejection direction is parallel to the ejection force application direction of the ink droplet ejecting means.

Twelfth Embodiment

Figure 19:
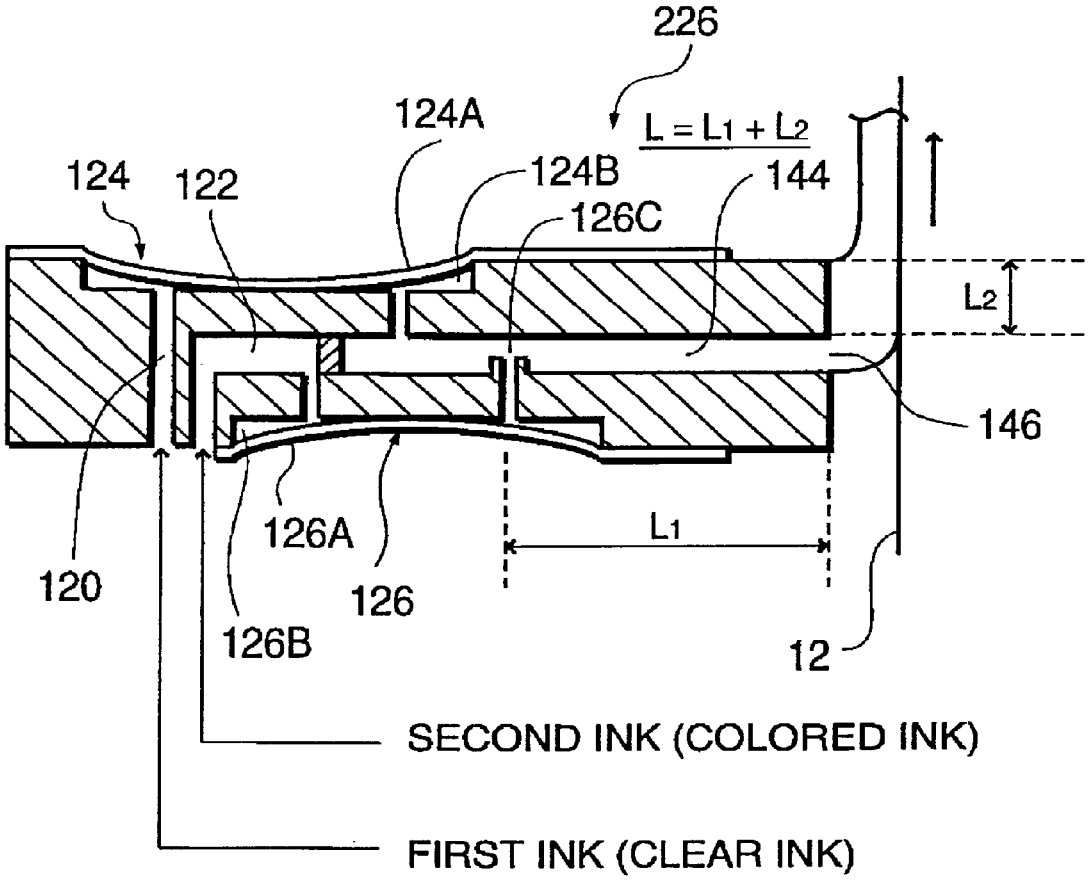
FIG. 19 is an enlarged sectional view of the image forming section (recording head) according to a twelfth embodiment of the present invention to which the continuous coating mode is applied.

An ink ejection head 226 shown in FIG. 19 is of a continuous coating mode with respect to the ink ejection head 116 of the ink jet mode shown in FIG. 18. Specifically, in the ink jet mode of FIG. 18, the ink is flied as the ink droplet 150 from the ink ejection port 146, and attached to the print paper 12. On the other hand, in the continuous coating mode of FIG. 19, the ink is ejected or extruded as a continuous flow from the ink ejection port 146, and continuously applied to the print paper 12 which is disposed opposite to the ink ejection port 146 to relatively move.

In this case, the distance L from the second ink (colored ink) ejection port 126C until the ink is detached from the ink ejection port 146 is determined as follows. specifically, the distance is a sum ($L=L_1+L_2$) of a distance $L_1$ from the second ink ejection port 126C to the ink ejection port 146 and a distance $L_2$ supposedly from when the ink ejected from the ink ejection port 146 adheres to the print paper 12 until the ink is detached from the ink ejection port 146. Additionally in FIG. 19, since the same parts as those of FIG. 18 are denoted with the same reference numerals, the description thereof is not repeated.

A state of ink flow in the ink channel 144 will next be described with reference to FIG. 20. Here it is supposed that an apparent channel diameter (diameter, unit: m) of the ink channel 144 is R, an apparent ink flow diameter (diameter, unit: m) of the second ink (colored ink) is Ri, and a ratio R/Ri is a flow diameter ratio h. Moreover, fluid viscosity of the first ink (clear ink) is $\mu c$ (Pa·sec, pascal second), the fluid viscosity of the second ink (colored ink) is $\mu i$ (Pa·sec), and a ratio $\mu c/\mu i$ is a viscosity ratio n. That is, the flow diameter ratio is h=R/Ri, and the viscosity ratio is $n=\mu c/\mu i$.

Figure 20:
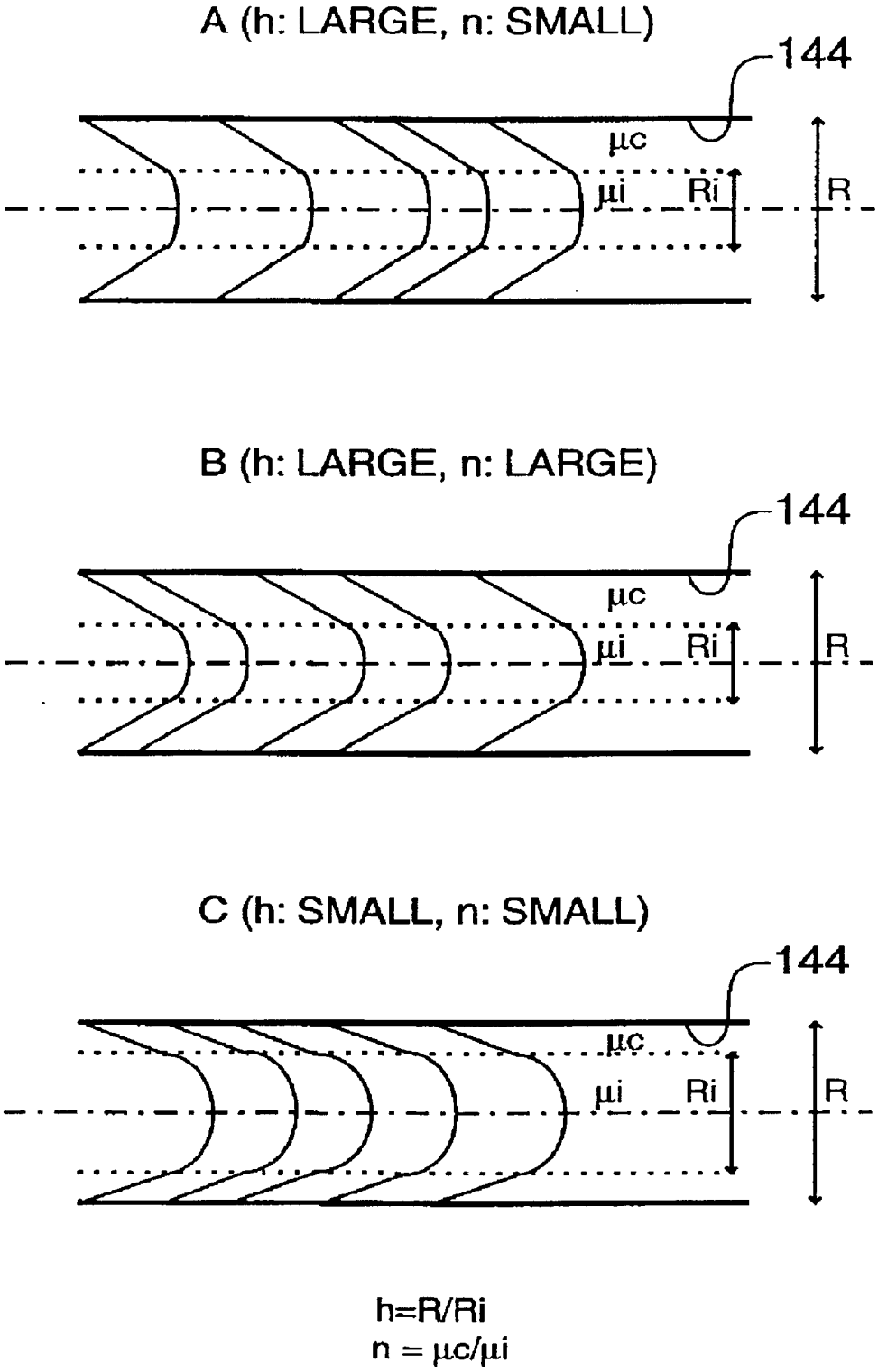
FIG. 20 is a view showing an ink flow in the ink channel in the eleventh and twelfth embodiments, in which the same phase portions of a first ink and a second ink are connected to each other and position changes are shown.

In FIG. 20 the same phase portions of the first and second inks are associated with each other and position changes are shown. Specifically, shown is a state in which. the first ink is drawn with the second ink. FIG. 20A shows a case in which the flow diameter ratio h is large and the viscosity ratio n is small, FIG. 20B shows a case in which h is large and n is small, and FIG. 20C shows a case in which h is small and n is small.

When the viscosity ratio n is small, the first ink (clear ink) easily slips against the inner wall of the ink channel 144, and when the ratio n is small in a fixed range, phase deviation of both inks is reduced (see FIGS. 20A, 20C). Therefore, the image quality is enhanced. Conversely, when n is large, the second ink easily precedes in the first ink, and the phase deviation of both inks becomes large (FIG. 20B). Therefore, the image quality is deteriorated. On the other hand, when the ratio n is more than 5 or less than 0.1, disorder easily occurs in the flow in a boundary of the first and second inks, and therefore a range of $0.1<n<5$ is preferable.

Moreover, when the flow diameter ratio h is large, a relative addition amount of the second ink (colored ink) to the first ink is reduced and a flow line shown in FIG. 20 has a sharp tip end (FIGS. 20A, 20B). Since the second ink is surrounded with the first clear ink in this manner, the second ink flows without contacting the inner wall of the ink channel 144. Furthermore, a phase difference is produced between the second ink and the first ink, but by setting the distance L to be sufficiently short as described above, the ink can be transported to the print paper 12 with a sufficiently small phase difference. As a result, the image quality is enhanced.

Figure 21:
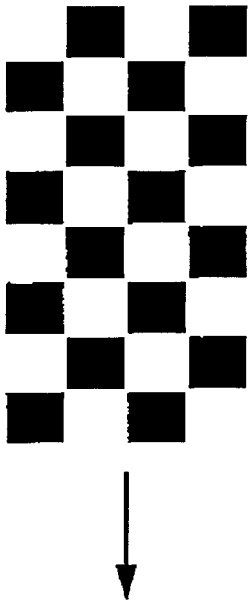
FIG. 21 is an explanatory view schematically showing image quality enhancement according to the eleventh, twelfth embodiments of the present invention.
Figure 22:
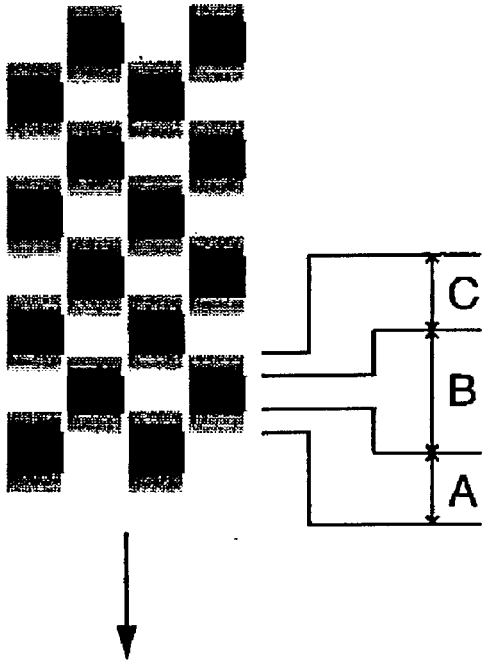
FIG. 22 PRIOR ART
FIG. 22 is an explanatory view schematically showing image quality deterioration in an image forming method according to a conventional pre-mix mode.

FIG. 21 schematically shows an ideal image quality state. As described above, the apparent channel diameter Ri of the second ink is set to be relatively small (h is large), the second ink has a sufficiently larger viscosity than that of the first ink (n<1), and the distance L after the inks are confluent until the inks are detached from the ink ejection port 146 is sufficiently small. In this case, the phase difference between the second ink (colored ink) and the first ink can sufficiently be reduced. Therefore, the blur shown by A and C in FIG. 22 can be eliminated. As a result, as shown in FIG. 21, an image edge becomes sharp, and the image quality becomes satisfactory.

The inventors have developed the aforementioned considerations, and further studied a relationship between the Reynolds number Re and the image quality. As a result, it has been found that in the flow system of the ink flowing in the ink channel 144, the laminar flow can exist at Reynolds number (Re) less than 100. The Reynolds number Re is a non-dimensional parameter defined by Re $\rho Dv/\mu$, where $\rho$ is a fluid density (kg/m$^3$), D is a channel representative diameter (m), V is an average flow velocity (m/sec), and $\mu$ is a fluid viscosity (viscosity coefficient, pascal·second (Pa·sec)).

When a numeric value close to an actual value is used as a representative value to obtain the Reynolds number Re, a condition of 100 or less is satisfied with a sufficient allowance. For example, when $$V=4\times10^{-1}\ [\text{m/sec}],$$

$$D=30\ \mu\text{m}=3\times10^{-5}\ [\text{m}],$$

$$\rho=1.1\times10^{3}\ [\text{kg/m}^3],$$

and $$\mu=3\times10^{-3}\ [\text{Pa·sec}],$$

then Reynolds number becomes $$Re=4.4$$

Moreover, the applicant have considered that the flow diameter ratio h, viscosity ratio n and distance L are used to introduce a new judgment value P for image quality judgment (judgment of sharpness of the image edge). This judgment value P is defined as follows.

$$P=\frac{n+(h^2-1)}{nL}=\frac{h^2-1}{nL}+\frac{1}{L}$$

It is considered that in the judgment value P, a first term ($h^2-1$) corresponds to a flow area difference between both inks, and that when the difference becomes larger, and the viscosity ratio n is smaller, the image blur is reduced. Therefore, ($h^2-1$)/n is considered to be a term indicating an influence by the area and viscosity. To align a dimension with that of a second term [1/L] described later, the term ($h^2-1$)/n is divided by the value L. As a result, the first term is ($h^2-1$)/nL.

The second term 1/L of the judgment value P is an indication of little disorder generated in the ink flow. Therefore, it has been found that by setting the judgment value P to be a sum of the first and second terms, the value P can be used as the indication of the image edge sharpness. The inventors calculated the judgment value P with respect to various cases in which the viscosity $\mu c$, $\mu i$, flow diameter R, Ri, distance L are changed. Moreover, in these cases, the actual image was obtained by using the ink ejection head having the above-mentioned Reynolds number 4.4. Results are shown in the following Table 1.

TABLE 1

| $\mu c$ (mPa · sec) | $\mu i$ (mPa · sec) | $n=\frac{\mu c}{\mu i}$ | R (mm) | Ri (mm) | $h=\frac{R}{Ri}$ | L (mm) | P (mm$^{-1}$): $\frac{n+(h^2-1)}{nL}$ | Image Quality |
|---|---|---|---|---|---|---|---|---|
| 2 | 2 | 1 | 0.02 | 0.018 | 1.11 | 0.1 | 12 | × |
| 2 | 2 | 1 | 0.02 | 0.012 | 1.67 | 0.1 | 28 | × |
| 2 | 2 | 1 | 0.02 | 0.012 | 1.67 | 0.05 | 56 | × |
| 2 | 2 | 1 | 0.02 | 0.012 | 1.67 | 0.02 | 139 | Δ |
| 2 | 2 | 1 | 0.02 | 0.01 | 2.5 | 0.1 | 63 | × |
| 2 | 2 | 1 | 0.02 | 0.01 | 2.5 | 0.05 | 125 | Δ |
| 2 | 2 | 1 | 0.02 | 0.01 | 2.5 | 0.02 | 313 | ○ |
| 3 | 5 | 0.6 | 0.02 | 0.018 | 1.11 | 0.1 | 14 | × |
| 3 | 5 | 0.6 | 0.02 | 0.012 | 1.67 | 0.05 | 79 | × |
| 3 | 5 | 0.6 | 0.02 | 0.012 | 1.67 | 0.02 | 198 | ○ |
| 3 | 5 | 0.6 | 0.02 | 0.01 | 2.5 | 0.1 | 98 | Δ |
| 3 | 5 | 0.6 | 0.02 | 0.01 | 2.5 | 0.05 | 195 | ○ ← b |
| 3 | 5 | 0.6 | 0.02 | 0.01 | 2.5 | 0.02 | 488 | ○ |
| 1.5 | 6 | 0.25 | 0.02 | 0.012 | 1.67 | 0.1 | 81 | Δ ← a |
| 1.5 | 6 | 0.25 | 0.02 | 0.012 | 1.67 | 0.05 | 162 | Δ |
| 1.5 | 15 | 0.1 | 0.02 | 0.018 | 1.11 | 0.1 | 33 | × |
| 2 | 20 | 0.1 | 0.02 | 0.012 | 1.67 | 0.1 | 188 | Δ |
| 2 | 20 | 0.1 | 0.02 | 0.01 | 2.5 | 0.1 | 535 | ○ |

In Table 1, for the image quality shown in a right column, a bad image quality-is shown by a cross mark (x), a good image quality is shown by a circle mark (○), and a medium image quality is shown by a triangle mark (Δ). As a minimum value of the judgment value P showing the medium (triangle mark; Δ) or higher image quality, P=81 mm$^{-1}$ is obtained as shown by an arrowhead a in Table 1. Moreover, as the minimum value of the judgment value P showing the satisfactory image quality (circle mark; ○), P=195 mm$^{-1}$ is obtained as shown by the arrowhead b. From this, it has been found that the medium quality image is obtained with P>81 mm$^{-1}$, and the high quality image is obtained with P>195 mm$^{-1}$.

In the aforementioned eleventh and twelfth embodiments, one type of the second ink (image forming ink, colored ink) is used, but a plurality of inks having different colors may be ejected to the common ink channel 144. For example, the respective colored inks of yellow (Y)., magenta (M), cyan (C) and black (K) are ejected into the clear ink from four projections protruding into the ink channel 144. These color inks are enveloped in the clear ink and ejected from the ink ejection port 146 while maintaining the laminar flow.

In the ink ejection head 116 of the ink jet mode shown in FIG. 18, the ink droplet is flied by a thermal ink jet mode in which the ink is subjected to nucleate boiling by the heater 148, but other modes may be used. For example, a mode for vibrating the diaphragm with the piezoelectric device, a continuous ink jet mode, an electrostatic attraction ink jet mode, an ultrasonic ink jet mode, and the like can be used.

As described above, in the eleventh and twelfth embodiments of the present invention, by setting the viscosity of the image non-forming ink to be smaller than the viscosity of the image forming ink, joining the image forming ink into the image non-forming ink in such a manner that the image forming ink fails to contact the inner wall of the ink channel, and leading the inks to the ink ejection port as the laminar flow. Accordingly, no disorder occurs in flows of a plurality of inks in the ink channel, and the image blur can be prevented. Therefore, the image quality is enhanced.

In order to form the ink flow in the ink channel as the laminar flow, it is preferable to use the flow system having Reynolds number less than 100, and the ink channel is preferably formed in a linear shape. When the viscosity ratio n, flow diameter ratio h and distance L are set to obtain the judgment value P of a fixed value 81 $mm^{-1}$ or more, a considerably satisfactory image is obtained, and when the setting is performed to obtain the judgment value P of 195 $mm^{-1}$ or more, the image quality is further enhanced.

What is claimed is:

1. An image forming method for forming an image on an image receiving medium with a recording liquid which includes an image forming liquid for finally forming an image and an image non-forming liquid for forming no image after image formation, a mixing ratio of the image forming liquid and the image non-forming liquid being varied based on an image signal, said method comprising steps of:

a) allowing said image non-forming liquid to flow in a recording liquid channel to an ejection port;

b) supplying said image forming liquid through an aperture in a wall of said recording liquid channel and into said image non-forming liquid flowing in said recording liquid channel to form said recording liquid so that the image forming liquid in the recording liquid is prevented from contacting an inner wall surface of said recording liquid channel;

c) delivering said recording liquid to the ejection port; and d) ejecting said recording liquid from the ejection port to the image receiving medium to form the image thereon.

2. The image forming method according to claim 1, wherein the image forming liquid is extruded into a laminar flow of the image non-forming liquid flowing through the recording liquid channel, and the image forming liquid enveloped in the image non-forming liquid is delivered to the ejection port.

3. The image forming method according to claim 1, wherein the image forming liquid is extruded along a direction perpendicular to a flow direction of the image non-forming liquid.

4. The image forming method according to claim 1, wherein the image forming liquid is extruded along a direction inclined to a flow direction of the image non-forming liquid.

5. The image forming method according to claim 1, wherein the image forming liquid is extruded along a direction parallel to a flow direction of the image non-forming liquid.

6. The image forming method according to claim 1, wherein, at said step b) a plurality of image forming liquids are extruded into a common image non-forming liquid flow.

7. The image forming method according to claim 1, wherein the position where the image forming liquid is extruded into a flow of the image non-forming liquid at the step d) is apart from the inner wall of the recording liquid channel by at least 4 $\mu$m.

8. The image forming method according to claim 1, wherein, at said step d), the recording liquid is ejected from the ejection port to be transferred to the image receiving medium as a continuous flow while the image forming liquid is maintained to be enveloped in the image non-forming liquid.

9. The image forming method according to claim 1, wherein said ejection port is disposed in a recording head, and said recording liquid is transferred to said image receiving medium which relatively moves with respect to the recording head to form the image.

10. The image forming method according to claim 1, wherein a viscosity of said image non-forming liquid is set to be smaller than a viscosity of said image forming liquid, and the recording liquid flowing through said recording liquid channel to said ejection port is maintained as a laminar flow so that said image forming liquid is prevented from contacting an inner wall of said recording liquid channel.

11. The image forming method according to claim 10, wherein Reynolds number of a flow system in the recording liquid channel from a confluent position of the image forming liquid and the image non-forming liquid to the ejection port is set to 100 or less.

12. The image forming method-according to claim 10, wherein the image forming liquid is added midway to the image non-forming liquid which flows straight in the linear recording liquid channel.

13. The image forming method according to claim 10, wherein the following relationship is established between the image non-forming liquid and the image forming liquid:

$$\frac{n+(h^2-1)}{nL} > 81\ \mathrm{mm}^{-1}$$

where h=R/Ri, n=$\mu$c/$\mu$i,

R: an apparent diameter of the recording liquid channel;

Ri: an apparent flow diameter of the image forming liquid;

$\mu$c: a fluid viscosity (Pa·sec) of the image non-forming liquid;

$\mu$i: a fluid viscosity (Pa·sec) of the image forming liquid; and

L: a distance (mm) after the image forming liquid is confluent with the image non-forming liquid until the recording liquid is removed from the ejection port.

14. The image forming method according to claim 13 wherein the image non-forming liquid and the image forming liquid establish the following relationship:

$$\frac{n+(h^2-1)}{nL} > 195 \text{ mm}^{-1}.$$

15. An image forming apparatus for forming an image on an image receiving medium with a recording liquid which includes an image forming liquid for finally forming an image and an image non-forming liquid for forming no image after image formation, a mixing ratio of the image forming liquid and the image non-forming liquid being varied based on an image signal, said apparatus comprising:

an ejection port for ejecting said recording liquid onto the image receiving medium;

a recording liquid channel for delivering the image non-forming liquid to said ejection port;

an extruding port for extruding the image forming liquid into the image non-forming liquid to form said recording liquid, said extruding port is projected into the recording liquid channel from an inner wall of the recording liquid channel so as to be disposed away from the inner wall of the recording liquid channel through which said image non-forming liquid flows and is opened in a flow of the image non-forming liquid; and an image forming liquid channel for supplying the image forming liquid through said extruding port.

16. The image forming apparatus according to claim 15, wherein said extruding port is formed in a tip end of a projection disposed on the inner wall of the recording liquid channel, and opened to be directed in a vertical direction with respect to a flow direction of the image non-forming liquid.

17. The image forming apparatus according to claim 15, wherein said extruding port is formed in a tip end of a projection disposed on the inner wall of the recording liquid channel, and opened to be directed in an oblique downstream direction with respect to a flow direction of the image non-forming liquid.

18. The image forming apparatus according to claim 16, wherein said projection disposed on the inner wall of the recording liquid channel has a cylindrical shape.

19. The image forming apparatus according to claim 16, wherein said projection disposed on the inner wall of the recording liquid channel has an elongated elliptical sectional shape which is long in the flow direction of the image non-forming liquid.

20. The image forming apparatus according to claim 16, wherein said projection has a vessel bottom shape whose bottom portion is held on the inner wall of the recording liquid channel and whose deck side is advanced into the flow of the image non-forming liquid, and the image forming liquid ejection port is opened on said deck side.

21. The image forming apparatus according to claim 17, wherein said projection disposed on the inner wall of the recording liquid channel has a cylindrical shape.

22. The image forming apparatus according to claim 17, wherein said projection disposed on the inner wall of the recording liquid channel has an elongated elliptical sectional shape which is long in the flow direction of the image non-forming liquid.

23. The image forming apparatus according to claim 17, wherein said projection has a vessel bottom shape whose bottom portion is held on the inner wall of the recording liquid channel and whose deck side is advanced into the flow of the image non-forming liquid, and the image forming liquid ejection port is opened on said deck side.

24. The image forming apparatus according to claim 15, wherein said recording liquid channel has a tubular shape with a constant section area and has an inlet of said image non-forming liquid in one end and said ejection port in the other end, and said extruding port is opened to be directed in a flow direction of the image non-forming liquid from said one end of the recording liquid channel.

25. The image forming apparatus according to claim 15, wherein a plurality of extruding ports for extruding ejecting different image forming liquids are disposed apart from the inner wall of the recording liquid channel and opened into the flow of the image non-forming liquid.

26. The image forming apparatus according to claim 15, further comprising a recording head which is provided with said ejection port for ejecting the recording liquid and which relatively moves with respect to said image receiving medium.

27. The image forming apparatus according to claim 26, wherein said recording head is disposed in the vicinity of and opposite to the image receiving medium, and the recording liquid is ejected from the ejection port and transferred as a continuous fluid flow to the image receiving medium.

28. An image forming apparatus for forming an image on an image receiving medium with a recording liquid which includes an image forming liquid for finally forming an image and an image non-forming liquid for forming no image after image formation, a mixing ratio of the image forming liquid and the image non-forming liquid being varied based on an image signal, a viscosity of the image non-forming liquid being smaller than the viscosity of the image forming liquid, said apparatus comprising:

a recording liquid channel for delivering the recording liquid to an ejection port, the image non-forming liquid and the image forming liquid being joined in the recording liquid channel to form the recording liquid as a laminar flow to said ejection port;

means for supplying the image non-forming liquid to said recording liquid channel on an upstream side from a confluent position of the image non-forming liquid and the image forming liquid;

an image forming liquid extruding port which is projected into the recording liquid channel from a wall surface of the recording liquid channel so as to be disposed away from the wall surface of said recording liquid channel and is opened in the image non-forming liquid; and means for supplying the image forming liquid through the image forming liquid extruding port.

29. The image forming apparatus according to claim 28, wherein supply systems of the image forming liquid and the image non-forming liquid is provided with flow rate control means, respectively.

30. The image forming apparatus according to claim 28, wherein said recording liquid channel is formed in a straight tubular shape perpendicular to an opening surface of the ejection port, and the image forming liquid extruding port is formed on a tip end of a projection disposed on an inner wall of said recording liquid channel.

31. The image forming apparatus according to claim 28, wherein respective flow rates of the image forming liquid and the image non-forming liquid, and distance between said a confluent point and the ejection port are set in such a manner that a phase difference between the image forming liquid and the image non-forming liquid at the ejection port is 20 $\mu$m or less with respect to the same image signal.

32. The image forming apparatus according to claim 28, further comprising a recording head which is provided with said ejection port and which relatively moves with respect to said image receiving medium.

33. The image forming apparatus according to claim 32, wherein said recording head is disposed in the vicinity of and opposite to the image receiving medium, and the recording liquid is ejected from the ejection port and transferred as a continuous fluid flow to the image receiving medium.

34. An image forming method for ejecting an image non-forming ink for finally forming no image and an image forming ink for finally forming an image from an ink ejection port by changing a mixture proportion based on an image signal, and transferring the inks to an image receiving medium to form the image thereon, said method comprising steps of:

setting a viscosity of said image non-forming ink to be smaller than a viscosity of said image forming ink;

joining said image forming ink to said image non-forming ink midway in an ink channel for feeding said image non-forming ink as a laminar flow to the ink ejection port so that, after said joining, said non-forming ink contacts an inner wall of said ink channel and said image forming ink is prevented from contacting the inner wall of said ink channel; and delivering the inks as the laminar flow to the ink ejection port.

* * * * *